US009651055B2

(12) United States Patent
Burgess et al.

(10) Patent No.: US 9,651,055 B2
(45) **Date of Patent: *May 16, 2017**

(54) SLURRY PUMP IMPELLER

(71) Applicant: Weir Minerals Australia, Ltd., Artarmon, NSW (AU)

(72) Inventors: Kevin Edward Burgess, Carlingford (AU); Wen-Jie Liu, Eastwood (AU); Luis Moscoso Lavagna, North Ryde (AU); Garry Bruce Glaves, Marsfield (AU)

(73) Assignee: Weir Minerals Australia Ltd. (AU)

( * ) Notice: Subject to any disclaimer, the term of this patent is extended or adjusted under 35 U.S.C. 154(b) by 717 days.

This patent is subject to a terminal disclaimer.

(21) Appl. No.: 13/970,443

(22) Filed: Aug. 19, 2013

(65) Prior Publication Data

US 2014/0044545 A1 Feb. 13, 2014

Related U.S. Application Data

(63) Continuation of application No. 12/736,933, filed as application No. PCT/AU2009/000661 on May 27, 2009, now Pat. No. 8,511,998.

(30) Foreign Application Priority Data

May 27, 2008 (AU) ..... 2008902860
Aug. 14, 2008 (AU) ..... 2008904164

(51) Int. Cl.
*F04D 29/22* (2006.01)

(52) U.S. Cl.
CPC ..... *F04D 29/2288* (2013.01); *Y10T 29/4973* (2015.01); *Y10T 29/49318* (2015.01)

(58) Field of Classification Search
CPC ..... F04D 29/2211; F04D 29/2216; F04D 29/2222; F04D 29/2225; F04D 29/2227;
(Continued)

(56) References Cited

U.S. PATENT DOCUMENTS 1,959,703 A 5/1934 Birmann
2,753,808 A 7/1956 Kluge
(Continued)

FOREIGN PATENT DOCUMENTS

AU 102206 S 12/1988
AU 319039 S 4/2008
(Continued)

OTHER PUBLICATIONS

Machine Translation of JP 09-310697.*
(Continued)

*Primary Examiner* — Nathaniel Wiehe
*Assistant Examiner* — Jason Davis
(74) *Attorney, Agent, or Firm* — Morriss O'Bryant Compagni

(57) ABSTRACT

A slurry pump impeller which includes a front shroud and a back shroud each having an inner main face with an outer peripheral edge and a central axis, a plurality of pumping vanes extending between the inner main faces of the shrouds, the pumping vanes being disposed in spaced apart relation. Each pumping vane includes a leading edge in the region of the central axis and a trailing edge in the region of the outer peripheral edges of the shrouds with a passageway between adjacent pumping vanes. Each passageway has associated therewith a discharge guide vane, each discharge guide vane being disposed within a respective passageway and located closer to one or the other of the pumping vanes and projecting from the inner main face of at least one of the or each shrouds.

19 Claims, 21 Drawing Sheets

(58) Field of Classification Search
CPC .. F04D 29/2272; F04D 29/2288; F04D 29/24; F04D 29/30; F05B 2240/30; F05B 2240/33
USPC ..... 416/185
See application file for complete search history.

(56) References Cited

U.S. PATENT DOCUMENTS

| | | | | |
|---|---|---|---|---|
| 3,228,344 | A | 1/1966 | Cooper | |
| 3,902,823 | A | 9/1975 | Minato et al. | |
| 3,953,150 | A | 4/1976 | Onal | |
| 4,231,413 | A * | 11/1980 | Bretzger | B22C 7/005 164/15 |
| D297,761 | S | 9/1988 | Shiraki | |
| 5,002,461 | A | 3/1991 | Young et al. | |
| 5,368,443 | A | 11/1994 | Turkia et al. | |
| D443,281 | S | 6/2001 | Sodergard | |
| 6,508,626 | B1 | 1/2003 | Sakurai et al. | |
| 6,619,910 | B1 * | 9/2003 | Burgess | F04D 29/2277 415/143 |
| 6,676,366 | B2 | 1/2004 | Kao | |
| 6,752,590 | B2 * | 6/2004 | Serio | F04D 29/2266 415/112 |
| 6,905,310 | B2 * | 6/2005 | Kawamoto | F04D 29/284 416/175 |
| D565,172 | S | 3/2008 | Chen | |
| D567,934 | S | 4/2008 | Shapiro | |
| D570,472 | S | 6/2008 | Otsuki et al. | |
| D570,996 | S | 6/2008 | Harman et al. | |
| D570,999 | S | 6/2008 | Harman et al. | |
| D571,000 | S | 6/2008 | Bei et al. | |
| D619,697 | S | 7/2010 | Uchikawa | |
| D621,027 | S | 8/2010 | Peia | |
| 8,025,478 | B2 | 9/2011 | Grimm et al. | |

FOREIGN PATENT DOCUMENTS

| | | | |
|---|---|---|---|
| AU | 100298 | S | 5/2008 |
| CA | 2120977 | | 10/1995 |
| FR | 2676783 | | 11/1992 |
| GB | 1277416 | | 6/1972 |
| JP | 9209984 | | 8/1997 |
| JP | 09310697 | A * | 12/1997 |
| WO | 2006133577 | | 12/2006 |

OTHER PUBLICATIONS

Abulnaga, Baha, Pumping Oil Sand Froth, 21st International Pump Users Symposium, Baltimore, Maryland, Mar. 2004, pp. 1-9, Texas A&M University, Texas, United States.
Abulnaga, B., E., Pumped Clean, World Coal, Feb. 2006, pp. 33-36, vol. 15, No. 2, Palladian Publications Ltd, United Kingdom.
Abulnaga, Baha E., Slurry Systems Handbook, ISBN 0-07-137508-2, May 2002, Ch. 8, pp. 8.11-8.14, The McGraw-Hill Companies, Inc., New York, United States.
Slurry Pump Impeller, U.S. Appl. No. 12/736,933, filed Feb. 10, 2011.

* cited by examiner

SLURRY PUMP IMPELLER

TECHNICAL FIELD

This disclosure relates generally to impellers for centrifugal slurry pumps. Slurries are usually a mixture of liquid and particulate solids, and are commonly used in the minerals processing, sand and gravel and/or dredging industry.

BACKGROUND ART

Centrifugal slurry pumps generally include a pump housing having a pumping chamber therein which may be of a volute configuration with an impeller mounted for rotation within the pumping chamber. A drive shaft is operatively connected to the pump impeller for causing rotation thereof, the drive shaft entering the pump housing from one side. The pump further includes a pump inlet which is typically coaxial with respect to the drive shaft and located on the opposite side of the pump housing to the drive shaft. There is also a discharge outlet typically located at a periphery of the pump housing.

The impeller typically includes a hub to which the drive shaft is operatively connected and at least one shroud. Pumping vanes are provided on one side of the shroud with discharge passageways between adjacent pumping vanes. In one form of impeller two shrouds are provided with the pumping vanes being disposed therebetween. The pump impeller is adapted to be run at different speeds to generate the required pressure head.

Slurry pumps are often required to be of a relatively large size with large diameter and width impellers. These pumps need to have relatively large discharge passageways in order to facilitate the passage of larger solids within the slurry and reduce the overall velocity of the slurry as it passes through the impeller. Slurry pump parts are subject to significant wear from the particulate matter in the slurry. As a result of this the number of pumping vanes is small, e.g. three, four or five. To try to reduce wear, slurry pumps are typically operated at relatively low speeds, e.g. 200 rpm up to 5000 rpm for very small pumps. The materials used for slurry pump parts are generally very hard metals or elastomeric materials which are adapted to be sacrificed and subsequently replaced. In order to change the pump performance in terms of flow and pressure head, centrifugal pumps can achieve this by variation of the pump speed.

Centrifugal slurry pumps often need to be capable of use over a wide range of flow and pressure head conditions. The performance of centrifugal slurry pumps may be adversely affected by the size, density and concentration of the particulate matter within the slurry and the pump performance will also be affected by wear. The need to be able to operate a slurry pump over a wide range of conditions means that, because of the larger passageways in the impeller, the pump performance does tend to vary substantially and provide less guidance to flow through the impeller, compared with a smaller and narrower water pump which provides good flow guidance. Particles and liquid in the slurry also tend to take different paths through the impeller depending on the particular particle size and the concentration in the slurry. This phenomenon will be exacerbated by wear of the impeller. Centrifugal pumps often suffer from loss of flow because of slip at the periphery of the impeller and recirculation at the inlet and outlet of the impeller. Vortex style flow patterns can be established in the discharge in the impeller at lower flows. Such phenomena normally result in poorer pump performance.

A further phenomena associated with centrifugal pumps is that of cavitation, which occurs mainly in the pump intake and impeller intake and which can affect pump performance and may even cause damage to the pump if the cavitation is strong and continuous. As mentioned, centrifugal slurry pump parts are made from hard metals or elastomeric materials which are difficult to cast or mould and, as such, in order to simplify the manufacturing process, the impeller shrouds are generally arranged more or less parallel to one another at a constant distance apart from the inlet to the outlet. Because of this, the outlet of the slurry pump impeller is also subjected to recirculation, vortex flow and flow patterns which induce wear.

There are other types of fluid machines which utilise rotating elements for transferring fluid. Examples of such machines include centrifugal compressors, turbines, and high speed water pumps. The design considerations and criteria for apparatus of these types are quite specific to such machines, are better understood, and are relatively easy to apply. Gases have a low density and generally no entrained particles, and can be pumped at much higher velocities within the fluid machine. As friction is a minor component in a gas machine, turbulence can be minimised by using multiple vanes or splitter vanes. Vanes used in these types of fluid machine are all relatively thin because these vanes are not subject to erosive wear. Furthermore, and most importantly, splitter vanes function in effect in a similar fashion to the main vanes to increase or add energy to the gaseous flow. The splitter vanes are usually slightly shorter than the main vanes so as not to interfere with flow at the leading edge of the main vanes.

Secondary (or splitter) vanes are normally of the same configuration as, but somewhat shorter than, the main vanes and are positioned approximately midway between the main vanes. These splitter vanes function to split the flow into smaller passageways and add more guidance to the flow, thus minimising turbulence. This type of gas machine typically operates at very high speeds in the order of 50,000 to 100,000 rpm. The number of blades is normally quite high, say 20, and there could be splitter vanes in between, so the vanes therefore need to be thin and the passageways small. Splitter or secondary vanes are normally of the same height as the main pumping vanes to allow maximum guidance and maximum energy to be input (or taken out) of the fluid as it passes through the rotating element of the machine.

High performance water pumps are similar in some ways to centrifugal compressors or turbines, and some of the same strategies are applicable such as a high number of vanes (typically 7 or higher), and splitter style vanes between the main vanes to control turbulence and/or to smooth the outlet pressure pulse by having a high number of vanes. In use this results in a higher number of smaller pressure pulses from each vane. Water pumps are not used to pump particles and so do not require high wear resistant materials. Typical high performance water pumps also run at higher speeds than standard water pumps and can run at speeds of 10,000 to 30,000 rpm.

The greater the number of main pumping vanes, the lesser the pressure pulse from each vane. To reduce the overall pressure pulse from a fluid machine it is known that increasing the number of vanes will smooth the pulse. This is why some water pumps and gas compressors have a larger number of vanes, and why splitter vanes are added to double the number of vanes. The design criteria for machines a gas compressor, turbine or high performance or high-speed water pump have no relevance to that of slurry pumps.

The provision of extra guidance or attempting to reduce turbulence by adding a higher number of thinner vanes or reducing the passageway size through an impeller is counterproductive in the design of a slurry pump. The very things that improve the performance in the machines of this type will not offer any solution when applied in a slurry pump.

Centrifugal slurry pumps are quite unique fluid machines because it is necessary to balance design, wear and manufacturability in different wear resistant materials. As discussed earlier it is normally necessary to develop a slurry pump that operates over a wide flow and speed range so that it is applicable to a wide range of applications, but this makes it more difficult to optimise the design. Typical designs are robust, but being a fluid machine, such pumps still suffer loss of performance and wear due to internal turbulence. Due to the special and restricting design constraints, various strategies have been used to improve performance but these have met with rather limited success. Design strategies to minimise turbulence are quite difficult given the minimum guidance that the slurry can be given by the impeller shroud, main vanes and casing as all of these components need to have satisfactory wear life.

An additional complication with slurry pumps is that the particles in the slurry do not follow the fluid streamlines. The larger and more massive the particle, the greater the particles deviation from the fluid streamline. Consequently, adding more vanes (or splitter style vanes) that are designed to guide the fluid along streamlines is not going to assist to guide the particles because the particles will simply cause increased turbulence and wear on any thin vanes and these vanes will quickly become worn and lose their effect in guiding the fluid. Performance will inevitably fall off rapidly in a short time period, and the power consumed will also increase rapidly, so that the machine cannot sustain its performance.

SUMMARY OF THE DISCLOSURE

In a first aspect, embodiments are disclosed of a slurry pump impeller which includes a front shroud and a back shroud each having an inner main face with an outer peripheral edge and a central axis, a plurality of pumping vanes extending between the inner main faces of the shrouds, the pumping vanes being disposed in spaced apart relation, each pumping vane including opposed main side faces one of which is a pumping or pressure side face, a leading edge in the region of the central axis and a trailing edge in the region of the outer peripheral edges of the shrouds with a passageway between adjacent pumping vanes, each passageway having associated therewith a discharge guide vane or vanelet, each discharge guide vane being disposed within a respective passageway and located closer to one or the other of the pumping vanes and projecting from the inner main face of at least one of the or each shrouds.

In some embodiments, each discharge guide vane can be located closer to the pumping or pressure side face of the closest adjacent pumping vane. The positioning of a discharge guide vane closer to one adjacent pumping vane can advantageously improve pump performance. In a normal circumstance without the presence of the discharge guide vane, a region of vortices extends in front of a pumping face of the pumping vanes, and extends at least midway into the middle of the flow discharge passageway. As a result, the vortices increase the turbulence in the flow of material which is passing through the impeller passageway during use, and in turn this turbulence extends into the volute region which surrounds the impeller. Increased turbulence can lead to increased wear of impeller and volute surfaces as well as increased energy losses, which ultimately require an operator to input more energy into the pump to achieve a desired throughput. Although the inventors surmised that placing a discharge guide vane within a generally central region of the discharge passageway would discourage or confine the turbulence region immediately in front of the pumping face of the impeller pumping vanes, it was found that the placement of discharge guide vanes midway across the width of the passageway had very little influence on the confinement of the turbulent region, and further experimentation showed that disposition of the discharge guide vanes closer to the pumping vane was able to substantially diminish the region of vortices away from the pressure face of the pumping vane. As a result, the intensity (or strength) of the vortices is diminished because they are not allowed to grow in an unconstrained manner.

Another known phenomenon of slurry pumps is discharge recirculation, in which slurry materials which leave the discharge passageways during the rotation of the impeller at low flows are forced back into the immediately adjacent impeller discharge passageway by the general operating pressure within the pump volute. When this occurs, in the normal circumstance the recirculated slurry mixes with the turbulent flow region of vortices to create an even larger and more problematic vortex region. The presence of discharge guide vanes in a suitable position to confine the turbulent region immediately in front of the pumping vane(s) means that there can be less interaction with the recirculated discharge flow, thereby reducing the potential for the combination of the two vortex regions, which would otherwise further reduce the efficiency of the pump. This also reduces the potential for particles to wear into the front or rear shrouds, thereby resulting in wear cavities in which vortex type flows could originate and develop further.

Furthermore, positioning a discharge guide vane closer to one adjacent pumping vane can advantageously improve pump performance such that the discharge guide vane in use does not obstruct the free flow of material through the passageway, which may occur in instances of particulate slurry flow where the discharge guide vanes about midway into the middle of the flow discharge passageway.

In some embodiments, each discharge guide vane can have an outer end adjacent the peripheral edge of one of the shrouds, the discharge guide vane extending inwardly and terminating at an inner end which is intermediate the central axis and the peripheral edge of the shroud with which it is associated. By extending to the peripheral edge of the shroud(s), the discharge guide vane can direct the flow within the impeller discharge passageway(s) and can also reduce the mixing of the split off flow regions at the immediate exit of the impeller into the already rotating flow pattern in the pump volute.

In some embodiments, each discharge guide vane can be shorter in length than the adjacent pumping vane such that the discharge guide vane in use does not obstruct the free flow of material through the passageway. In some embodiments, the length of each discharge guide vane is about one third or less of the length of the adjacent pumping vane. The discharge guide vane(s) are generally elongate to encourage the development of a consistent flow path of fluid and solids exiting the impeller during use.

In some embodiments, each said discharge guide vane can project from the inner main face of the back shroud. This is because in the normal circumstance of slurry flow entering the impeller, the region of vortices is concentrated adjacent to the back shroud rather than the front shroud.

In some embodiments, each said discharge guide vane can have a height which is from 5 to 50 percent of pumping vane width, where the width of the pumping vane is defined as the distance between the front and back shrouds of the impeller. The thickness of the discharge guide vane may be chosen depending on the pumping head and velocity requirements as well as the material to be pumped, as well as to the extent required to reduce turbulence within the main flow and also assist to reduce the amount of recirculation. In some embodiments, each said discharge guide vane can have a height which is from 20 to 40 percent of pumping vane width. In some embodiments, each said discharge guide vane can have a height of about 30 to 35 percent of the pumping vane width. If the discharge guide vane height is too small, then the benefit of confinement of the turbulent region is non-optimal, and if the discharge guide vane height is too tall, its influence can be to disturb and/or block the main flow, which is also non-optimal.

In some embodiments, each said discharge guide vane can be spaced from a respective pumping vane to which it is closest so as to modify flow of material through the passageway and thereby reduce turbulence and inhibit the displacement or separation of vortices formed by the flow from the face of the said pumping vane.

In some embodiments, for at least some of its length each discharge guide vane can be spaced from a respective pumping vane to which it is closest at a distance which at its closest point is about equal to the maximum thickness of the discharge guide vane. If the discharge guide vane spacing from the pumping face of the pumping vane is too small, then the velocity of any through flow of particulate slurry therebetween can be high with consequent increased erosive wear of the adjacent surfaces, which is non-optimal. It is envisaged that in other embodiments the spacing between the discharge guide vane and the adjacent pumping vane can be varied along its length by as little as 75% of the maximum thickness of the discharge guide vane, and by as much two or three times the maximum thickness of the discharge guide vane.

In some embodiments of the impeller, the angle subtended between the tangent to the periphery of the shroud and a line tangential to the front pumping face of the impeller pumping vane is substantially the same as the angle subtended between the tangent to the periphery of the shroud and a line tangential to the front face of the adjacent discharge guide vane. In such an arrangement the discharge guide vane can direct the flow within the impeller discharge passageway(s) and can also reduce the mixing of the split off flow regions at the immediate exit of the impeller into the already rotating flow pattern in the pump volute.

In some embodiments, each discharge guide vane can generally have the same shape and width of the main pumping vanes when viewed in a horizontal cross-section.

In some embodiments, each discharge guide vane can be of a tapering height, depending on the pumping requirements. This facilitates the removal of the impeller from its mould during manufacturing.

In some embodiments, each discharge guide vane can be of a tapering width, depending on the pumping requirements. Tapered ends of the discharge guide vanes can facilitate the smooth exit flow of slurry material from the passageways.

In some embodiments, one or more of the passageways can have associated therewith one or more inlet guide vanes, the or each inlet guide vane extending along a side face of the pumping vane and terminating at an opposite end which is intermediate the leading and trailing edges of the pumping vane with which it is associated.

In some embodiments, the or each inlet guide vane can be a projection from the main face of the pumping vane with which it is associated and which extends into a respective passageway.

In some embodiments, the or each inlet guide vane can be elongate to encourage the development of a consistent flow path of fluid and solids through the impeller during use.

In some embodiments the slurry pump impeller can further include auxiliary or expeller vanes located on an outer face of one or more of the shrouds.

In some embodiments, said auxiliary vanes can have bevelled edge portions.

In some embodiments, the impeller can have no more than five pumping vanes. In one form the impeller can have four pumping vanes. In one form the impeller can have three pumping vanes.

In an alternative embodiment, the impeller can be made up of three shrouds, and each shroud can have a discharge guide vane projecting therefrom. In one embodiment the discharge guide vanes are only on the inner main face of the back shroud.

In a second aspect, embodiments are disclosed of a slurry pump impeller which includes a front shroud and a back shroud each having an inner main face with an outer peripheral edge and a central axis, a plurality of pumping vanes extending between the inner main faces of the shrouds, the pumping vanes being disposed in spaced apart relation, each pumping vane including opposed main side faces one of which is a pumping or pressure side face, a leading edge in the region of the central axis and a trailing edge in the region of the outer peripheral edges of the shrouds with a passageway between adjacent pumping vanes, each passageway having associated therewith a discharge guide vane, the discharge guide vane being disposed within a respective passageway and located closer to one or the other of the pumping vanes and projecting from the inner main face of the back shroud, the length of each discharge guide vane being about one third or less of the length of the adjacent pumping vane, said discharge guide vane having a height of about 30 to 35 percent of the pumping vane width.

In a third aspect, embodiments are disclosed of a centrifugal slurry pump of the volute type comprising a pump casing having an inlet region and a discharge region, an impeller positioned within the pump casing and a drive shaft axially connected to said impeller, wherein the pump impeller is as disclosed in the first or second aspects.

In a fourth aspect, embodiments are disclosed of a method for the production of a casting of an impeller as disclosed in the first or second aspects, the method comprising the steps of:

pouring molten material into a mould for forming the casting;

allowing the molten material to solidify; and removing the mould at least in part from the resulting solidified casting.

In a fifth aspect, embodiments are disclosed of a method of retrofitting a discharge guide vane in an impeller of the type disclosed in the first or second aspects, where the guide vane is located at a main face of a shroud with which it is associated and which extends into a respective discharge passageway, the method comprising the steps of:

removing a guide vane when it has become a worn component; and subsequently fitting an unworn replacement guide vane to the impeller.

In a sixth aspect, embodiments are disclosed of a method of retrofitting an impeller into a centrifugal pump, the method comprising the steps of:

removing an installed impeller when it has become a worn component; and subsequently fitting into the pump an unworn replacement impeller of the type disclosed in the first or second aspects.

In a seventh aspect, embodiments are disclosed of an impeller for an existing centrifugal pump, the impeller being adapted for mounting within a casing of the existing pump as a retrofit so as to replace an existing impeller, whereby the configuration of the impeller is of the type disclosed in the first or second aspects.

In an eighth aspect, embodiments are disclosed of an impeller which includes at least one shroud having a main face with an outer peripheral edge and a central axis, a plurality of pumping vanes projecting from the main face of the shroud, the pumping vanes being disposed in spaced apart relation on the main face providing a discharge passageway between adjacent pumping vanes, each pumping vane including a leading edge in the region of the central axis and a trailing edge in the region of the peripheral edge, each pumping vane comprising opposed side faces extending between the leading and trailing edges of the vane, one or more of the pumping vanes having one or more inlet guide vanes associated therewith.

The use of inlet guide vanes has the advantage of reducing the development of recirculation fluid flow patterns at the impeller inlet and any vortex style flow patterns inside the impeller, all of which normally result in poorer pumping performance, for example because of cavitation. The inlet guide vanes provide guidance for the flow within the impeller discharge passageway(s). The inlet guide vanes can also incorporate some of the other advantages previously described for the discharge guide vanes.

In some embodiments, the or each inlet guide vane can be a projection from a side face of the pumping vane with which it is associated and which extends into a respective discharge passageway. In another embodiment, the or each inlet guide vane can be a recess which extends into a side face of the pumping vane, thereby forming a channel or groove through which fluid can flow in use. In still further embodiments, the impeller can have any combination of inlet guide vanes in the form of recesses and projections, located at the various side faces of the pumping vanes.

In some embodiments, the or each inlet guide vane can be elongate, to encourage the development of a consistent flow path of fluid and solids through the impeller during use.

In one form of this, the or each inlet guide vane may have an end adjacent the pumping vane leading edge, the guide vane extending along the side face of the pumping vane and terminating at an opposite end which is intermediate the leading and trailing edges of the pumping vane with which it is associated.

In some embodiments, the impeller can include two said shrouds, said pumping vanes extending therebetween from the respective main faces thereof. In one embodiment, the two shrouds are spaced apart with the main faces of the shrouds arranged generally parallel with respect to one another. In still further embodiments, the impeller can have more than two shrouds, for example three shrouds.

In some embodiments, one or more of said pumping vanes can have associated therewith two said inlet guide vanes, one located at each of the respective opposed side faces of the pumping vane. In still further embodiments, and depending on the pumping application, there can be more than one inlet guide vane located at a respective side face of each pumping vane. In a still further embodiment, each pumping vane can have associated therewith one or more of said inlet guide vanes on one side face and no inlet side vane on the opposing side face of the pumping vane.

In some embodiments, each said inlet guide vane can be disposed generally centrally on the side face of the pumping vane with which it is associated, in terms of its position away from an adjacent shroud.

In some embodiments, each said inlet guide vane can be about half of the length between the leading and trailing edges of the pumping vane with which it is associated, although in still further embodiments the inlet guide vane can be shorter or longer than this length, depending on the pumping requirements.

In some embodiments, each inlet guide vane can have a height of from 50 to 100 percent of pumping vane thickness, and the preferred thickness will be chosen from this range depending on the pumping head and velocity requirements as well as the material to be pumped.

In some embodiments, each inlet guide vane can be of a constant vane height along its length, although it is envisaged that in still other embodiments the vane height can be varied, depending on the pumping requirements.

In some embodiments, one or more of the discharge passageways can have associated therewith one or more discharge guide vanes, the or each discharge guide vane located at the main face of the at least one or each shroud and having an outer edge in the region of the peripheral edge of the shroud, the guide vane extending inwardly and terminating at an inner edge which is intermediate the central axis and the peripheral edge of the shroud.

In some embodiments, the or each discharge guide vane can be elongate to encourage the development of a consistent flow path of fluid and solids exiting the impeller during use.

In some embodiments, the discharge guide vane can be generally of the same shape and width as the main pumping vanes when viewed in a horizontal cross-section.

In a ninth aspect, embodiments are disclosed of a method of retrofitting an inlet guide vane in an impeller of the type defined in either the first or second aspects, where the guide vane is a projection from a side face of the pumping vane with which it is associated and which extends into a respective discharge passageway, the method comprising the step of:

removing a guide vane when it has become a worn component; and subsequently fitting an unworn replacement guide vane to the impeller.

In a tenth aspect, embodiments are disclosed of an impeller which includes at least one shroud having a main face with an outer peripheral edge and a central axis, a plurality of pumping vanes projecting from the main face of the shroud, the pumping vanes being disposed in spaced apart relation on the main face providing a discharge passageway between adjacent pumping vanes, each pumping vane including a leading edge in the region of the central axis and a trailing edge in the region of the peripheral edge of the shroud with a passageway between adjacent pumping vanes, each pumping vane comprising opposed side faces extending between the leading and trailing side edges of the vane, one or more of the pumping vanes having one or more inlet guide vanes associated therewith and one or more of the passageways having one or more discharge guide vanes associated therewith, the or each discharge guide vane located at the main face of at least one of the or each shrouds.

BRIEF DESCRIPTION OF THE DRAWINGS

Notwithstanding any other forms which may fall within the scope of the method and apparatus as set forth in the Summary, specific embodiments of the method and apparatus will now be described, by way of example, and with reference to the accompanying drawings in which.

DETAILED DESCRIPTION OF SPECIFIC EMBODIMENTS

Figure 1:
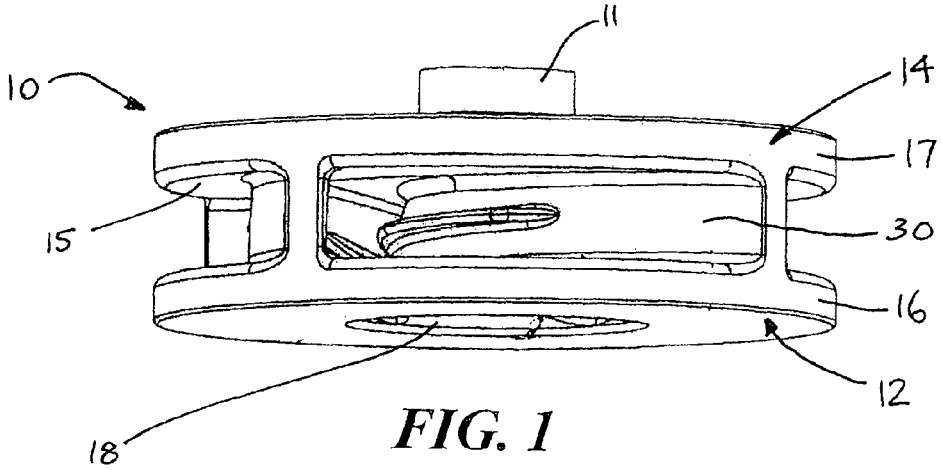
FIG. 1 illustrates an exemplary, schematic isometric view of a pump impeller in accordance with one embodiment.
Figure 2:
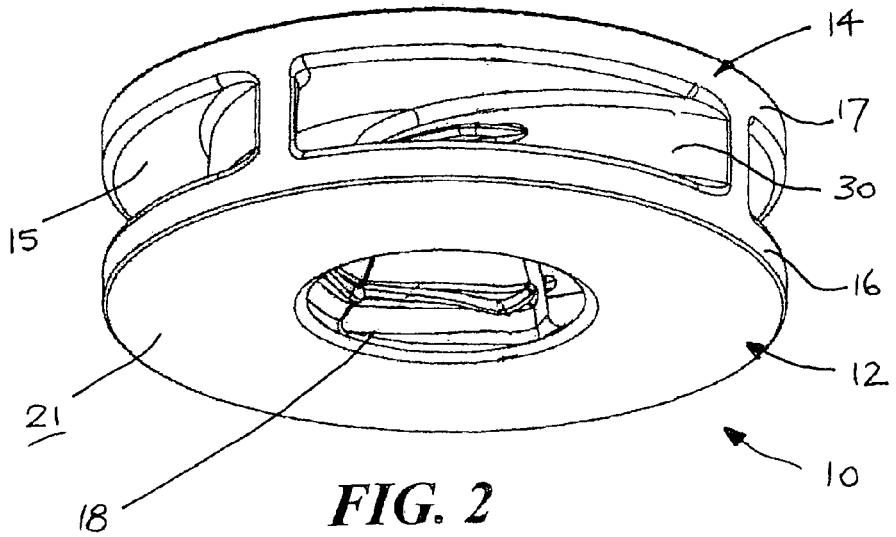
FIG. 2 illustrates a further isometric view of the impeller shown in FIG. 1, showing more underside detail.
Figure 3:
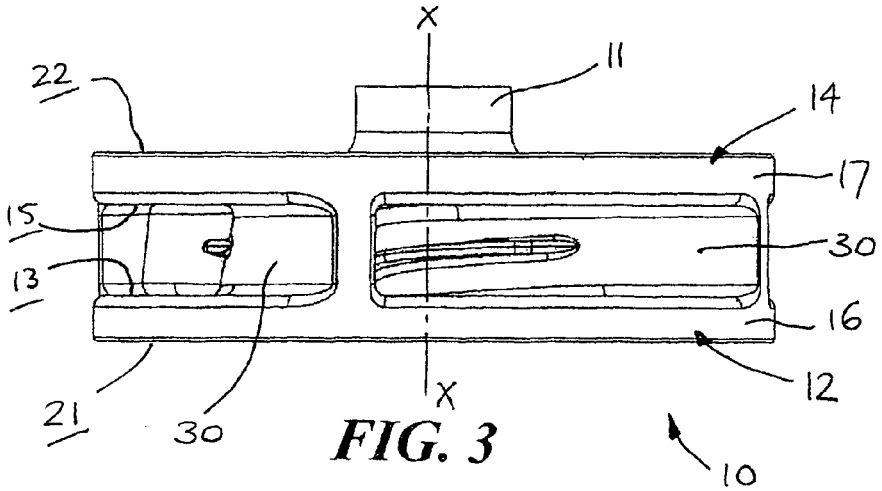
FIG. 3 illustrates a side elevation of the impeller shown in FIGS. 1 and 2.

Referring now to FIGS. 1 to 4, one embodiment of an impeller 10 is shown in which the impeller comprises a front shroud 12 and a back shroud 14 which are each in the form of a generally planar disc, each disc having a respective main inner face 13, 15, a respective outer face 21, 22 and a respective outer peripheral edge 16, 17. A hub 11 extends from an outer face 22 of the back shroud 14, the hub 11 being operatively connectable to a drive shaft (not shown) for causing rotation of the impeller about its central axis X-X (FIG. 3).

Figure 4:
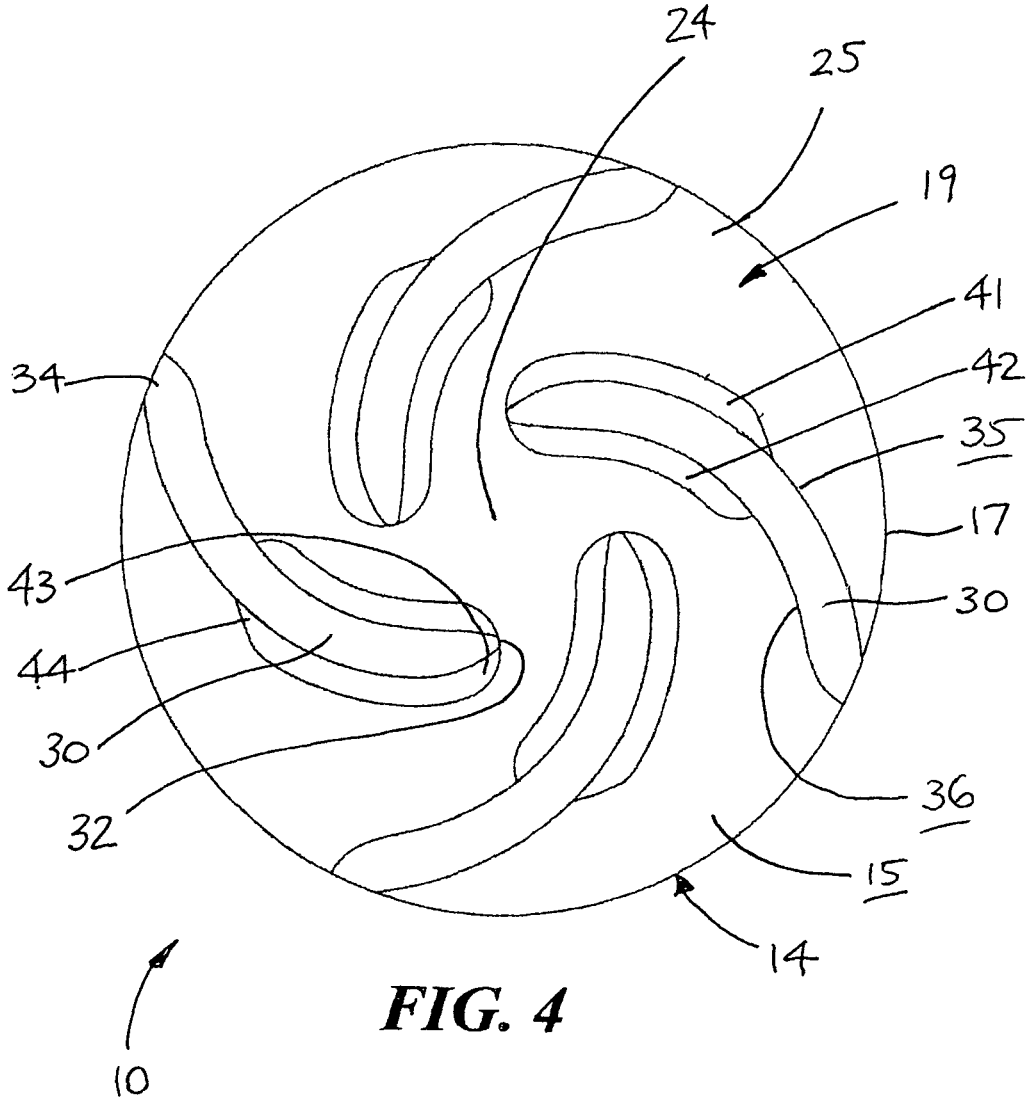
FIG. 4 illustrates a sectional view of the impeller shown in FIGS. 1 to 3 when sectioned across the impeller body midway between the shrouds.

An impeller inlet 18 is provided in the front shroud 12, the inlet 18 being coaxial with central axis X-X which is the axis of rotation of the impeller 10 in use. Four pumping vanes 30 extend between the opposing main inner faces 13, 15 of the shrouds 12, 14, and are spaced evenly around the main faces 13, 15 of the said shrouds 12, 14. As shown in FIG. 4 each pumping vane 30 is generally arcuate in cross-section and includes an inner leading edge 32 and an outer trailing edge 34 and opposed side faces 35 and 36, the side face 35 being a pumping or pressure side. The vanes are normally referred to as backward-curving vanes when viewed with the direction of rotation. Discharge passageways 19 are provided between adjacent pumping vanes 30 through which material passes from impeller inlet 18. Each passageway 19 has an inlet region 24 and a discharge region 25 located at the outer peripheral edge 16, 17 of the shrouds 12, 14 from which slurry passes to the pump discharge. The discharge region 25 is wider than the inlet region 24 so that the passageway 19 is generally V-shaped. Reference numerals identifying the various features described above have only been indicated on one of the vanes 30 for the sake of clarity.

Each pumping vane 30 has associated therewith two strip-like protrusions which act as slurry inlet guide vanes 41, 42. Each of these inlet guide vanes 41, 42 project from a respective side face 35, 36 of the pumping vane 30. Each inlet guide vane 41 and 42 is disposed centrally on respective side faces 35 and 36 of the pumping vane 30 with which it is associated and is in the form of an elongate protrusion which itself has an inner end 43 located closest to the inner leading edge 32 of the pumping vane 30, and an outer end 44 located about half way along a respective side face 35, 36. In other embodiments the guide vane(s) can be longer or shorter strips than is shown in these Figures.

Each inlet guide vane 41, 42 has a height of approximately 57% of the through-thickness of the pumping vane 30 when viewed in cross-section, although in further embodiments the guide vane height can be between 50% to 100% of the said pumping vane through-thickness. Each guide vane 41, 42 is of generally constant height along its length, although in other embodiments the guide vane can be tapered in shape. The guide vanes 41, 42 shown are of thickness which is about 55% of the average pumping vane 30 through-thickness, although this can be varied in other embodiments.

The effect of the guide vanes is to change the recirculation flow and characteristics of the pump because the passageways are smaller in the region of the vanes, thereby reducing the chance of the fluid streams mixing and recirculating back to the impeller inlet.

In other embodiments, the inlet guide vanes can be formed as a groove or recess which is located so as to extend into the material of the pumping vane. Such grooves can also act as fluid guidance passageways in the same manner as inlet guide vanes which are seated proud of a pumping vane side face.

Embodiments are also envisaged with any combination of inlet guide vanes in the form of recesses or projections located at the pumping vanes in the region of the inlet region of the discharge passageways.

In still other embodiments, the inlet guide vanes need not be located generally centrally on the pumping vane face, but can be located closer to one or the other of the shrouds, depending on the circumstances.

In still other embodiments, the inlet guide vanes need not extend about half-way along a respective side face of a pumping vane but can extend for a shorter or longer distance than this, depending on the fluid or slurry to be pumped.

In still other embodiments, there can be more than one inlet guide vane per side face of a pumping vane, or in some instances no inlet guide vane on one of the opposing side faces of any two pumping vanes which define a discharge passageway.

Figure 5:
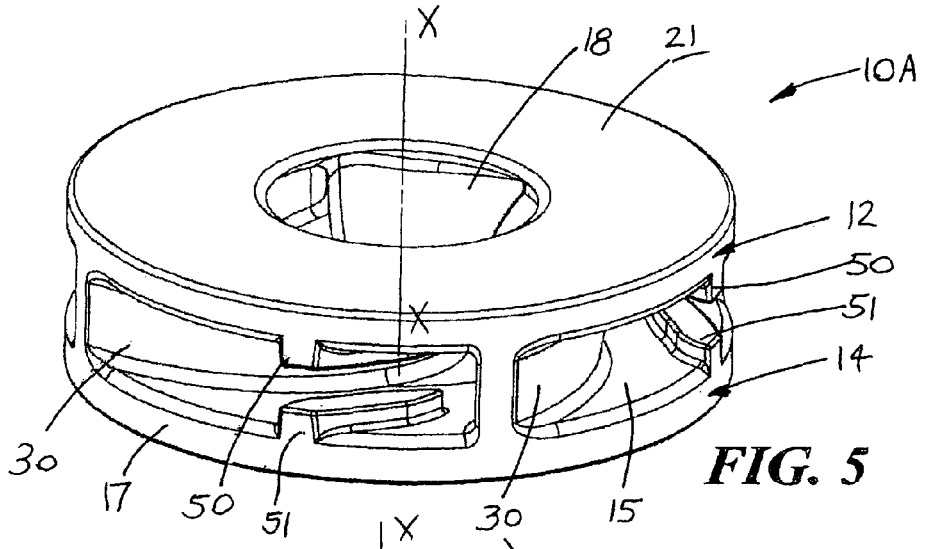
FIG. 5 illustrates an exemplary schematic isometric view of an impeller according to another embodiment.
Figure 6:
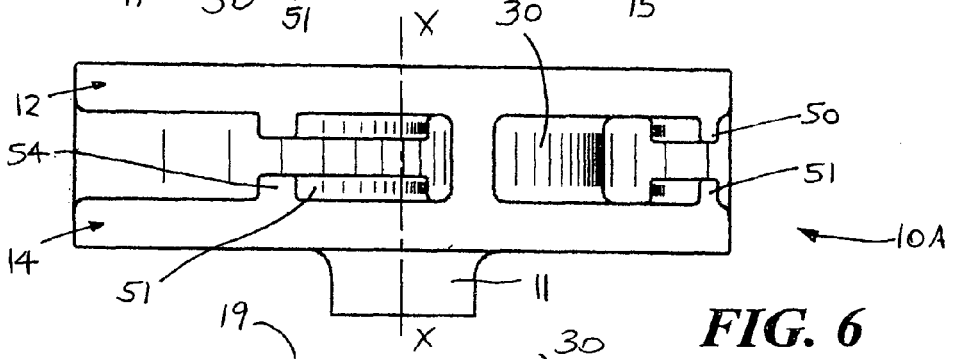
FIG. 6 illustrates a side elevation of the impeller shown in FIG. 5.
Figure 7:
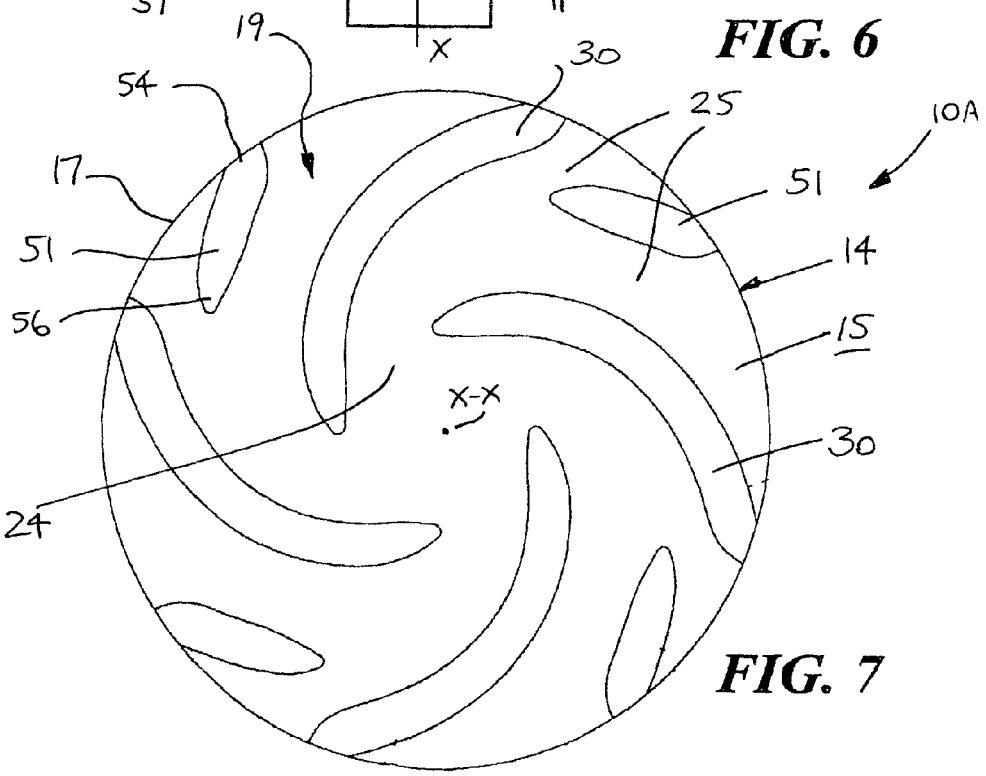
FIG. 7 illustrates a sectional view of the impeller shown in FIGS. 5 and 6 when sectioned across the impeller body midway between the shrouds.

In accordance with certain embodiments, an exemplary impeller 10A is illustrated in FIGS. 5 to 7. For convenience the same reference numerals have now been used to identify the same parts described with reference to FIGS. 1 to 4. Here the impeller 10A does not have inlet guide vanes but has a plurality of discharge guide vanes (or vanelets) 50, 51.

The discharge guide vanes 50, 51 are in the form of elongate, flat-topped projections which are generally sausage-shaped in cross-section. The discharge vanes 50, 51 extend respectively from the main faces 13, 15 of the respective shrouds 12, 14 and are arranged in between two adjacent pumping vanes 30. The discharge guide vanes 50, 51 have a respective outer end 53, 54 which is located adjacent to the outer peripheral edge 16, 17 of respective shrouds 12, 14. The discharge guide vanes 50, 51 also have an inner end 55, 56 which is located somewhere midway a respective passageway 19. As seen in FIG. 7, the inner ends 55, 56 of the discharge guide vanes 50, 51 are spaced some distance from the central axis X-X of the impeller 10A. The discharge guide vanes 50, 51 that are associated with each passageway 19 face one another, with their outer surfaces being spaced apart.

Each discharge guide vane 50, 51 shown has a height of about 33% of the width of the pumping vane 30, although in further embodiments the guide vane height can be between 5% to 50% of the said pumping vane width (distance between the shrouds 12, 14). Each guide vane 50, 51 is of generally constant height along its length, although in other embodiments the guide vane 50, 51 can be tapered in height and also tapered in width.

In still other embodiments, the discharge guide vanes need not be located generally centrally between respective pumping vanes on the shroud main inner face, but can be located closer to one or the other of the pumping vanes 30, depending on the circumstances.

In still other embodiments, the discharge guide vanes can extend for a shorter or longer distance into the discharge passageway than is shown in the embodiments of FIGS. 4 to 8, depending on the fluid or slurry to be pumped.

In still other embodiments, there can be more than one discharge guide vane per shroud inner main face, or in some instances no discharge guide vane on one of the opposing inner main faces of any two shrouds which define a discharge passageway.

In still other embodiments, the discharge guide vanes can be of a different cross-sectional width to the main pumping vanes, and may not even necessarily be elongate, so long as the desired effect on the flow of slurry at the impeller discharge is achieved.

It is believed that the discharge guide vanes will reduce the potential for high-velocity vortex type flows to form at low flows. This reduces the potential for particles to wear into the front or rear shrouds thereby resulting in wear cavities in which vortex type flows could originate and develop. The guide vanes will also reduce the mixing of the split off flow regions at the immediate exit of the impeller into the already rotating flow pattern in the volute. It is felt that the discharge guide vanes will smooth and reduce the turbulence of the flow from the impeller into the pump casing or volute.

Figure 8:
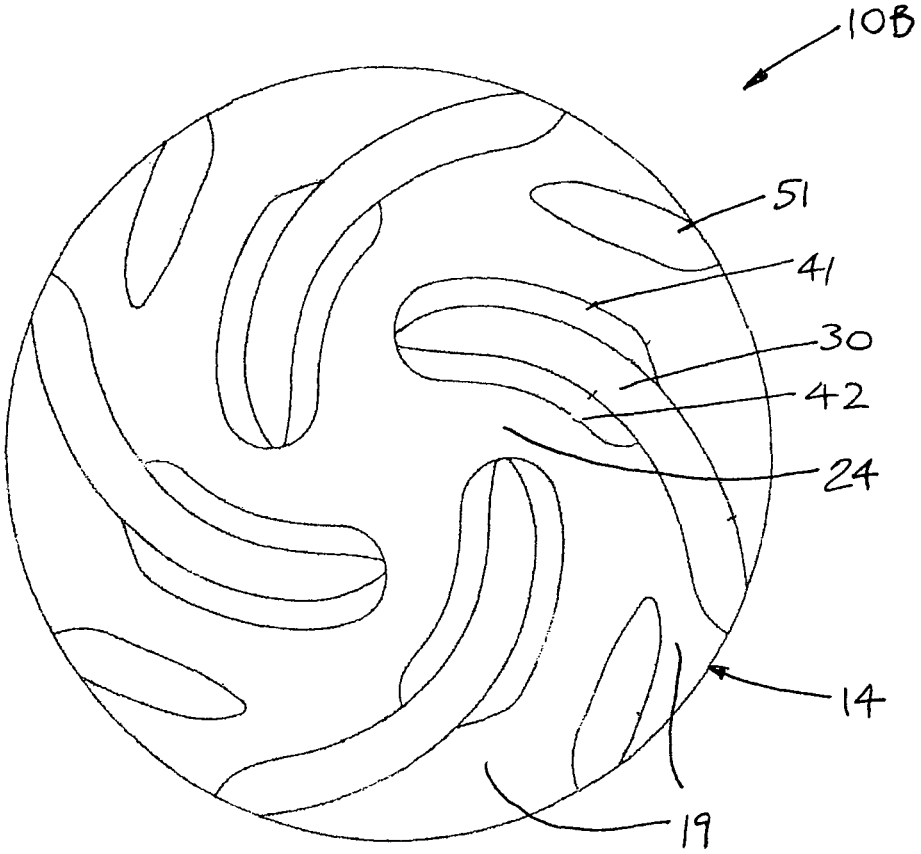
FIG. 8 illustrates an exemplary sectional view of an impeller in accordance with another embodiment.

Referring to FIG. 8 of the drawings there is shown an exemplary embodiment of an impeller 10B which comprises both the inlet guide vanes 41 and 42 and the discharge guide vanes 50 and 51 in combination.

Figure 9:
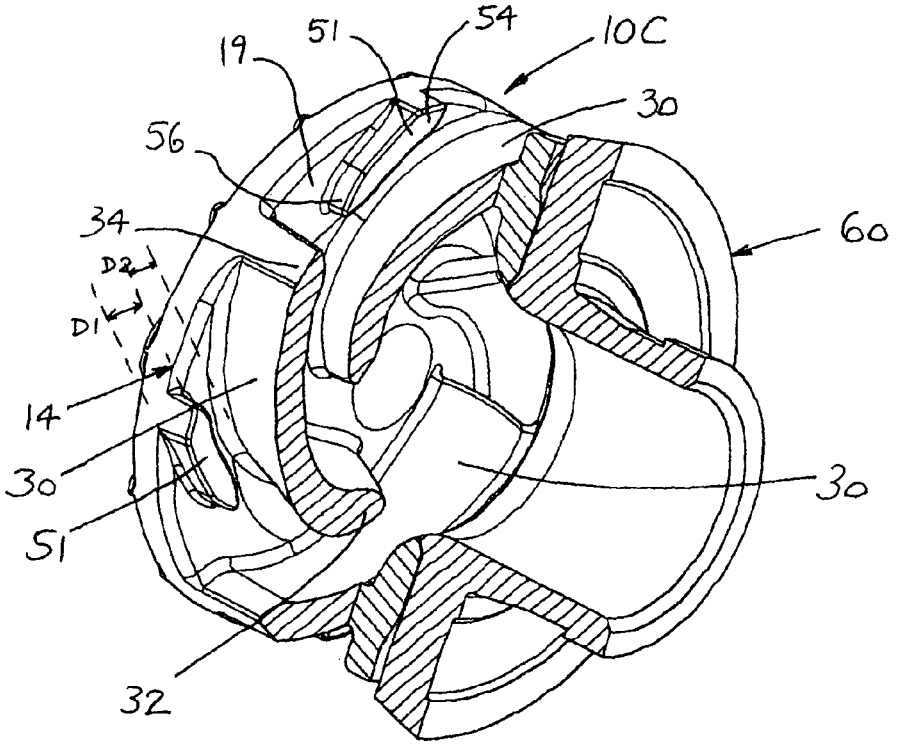
FIG. 9 illustrates an exemplary, part-sectional view of an impeller in accordance with another embodiment, which is illustrated in conjunction with an embodiment of a pump inlet component.
Figure 10:
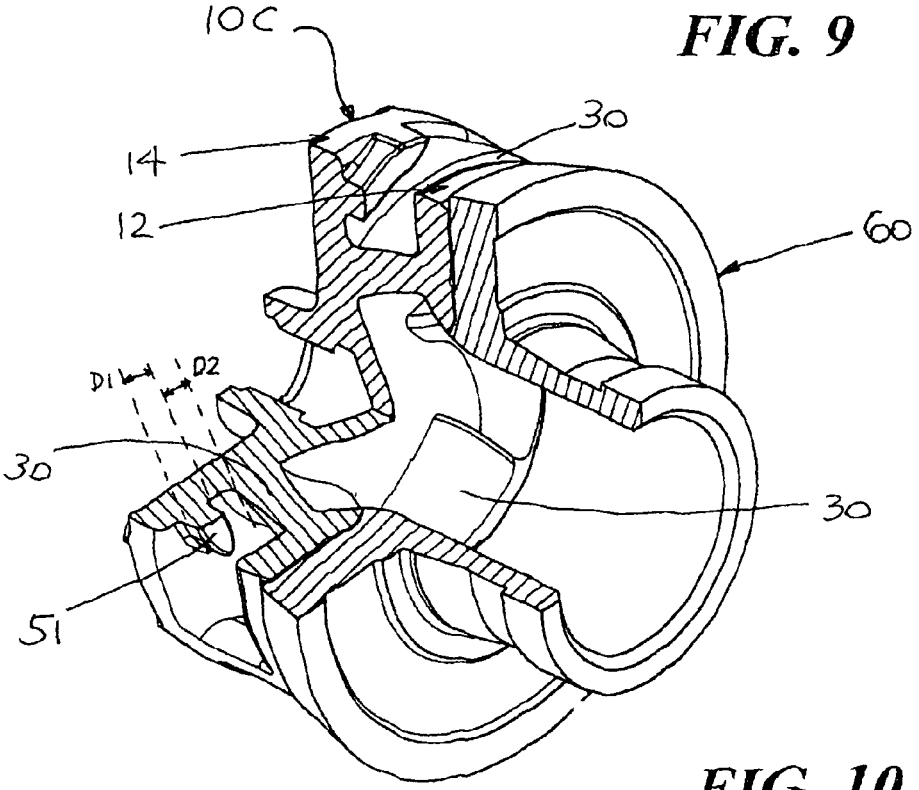
FIG. 10 illustrates a further sectional view of the impeller and pump inlet component shown in FIG. 9.
Figure 11:
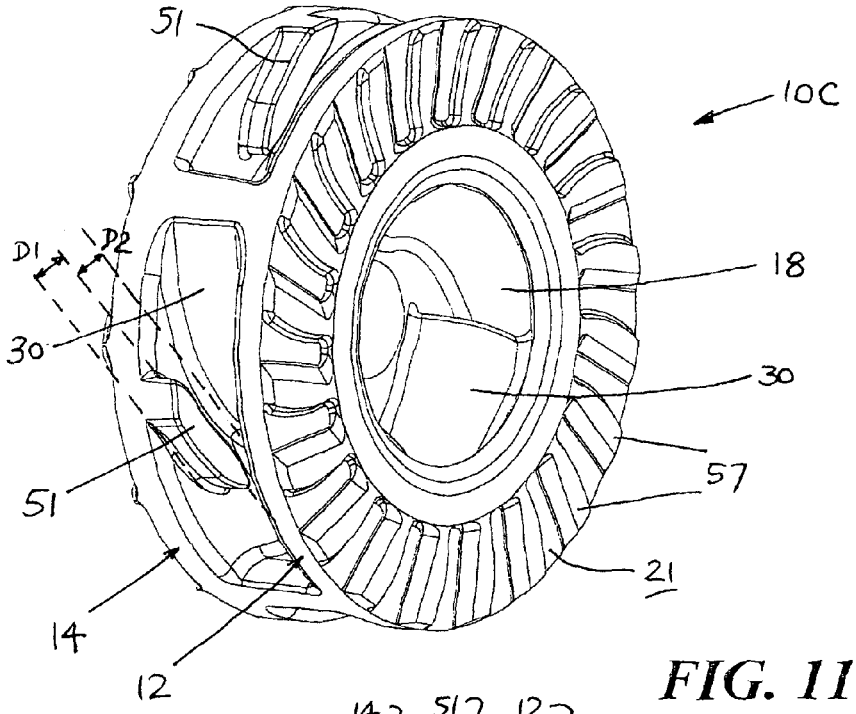
FIG. 11 illustrates a perspective view of the impeller shown in FIGS. 9 and 10 from the inlet side.
Figure 12:
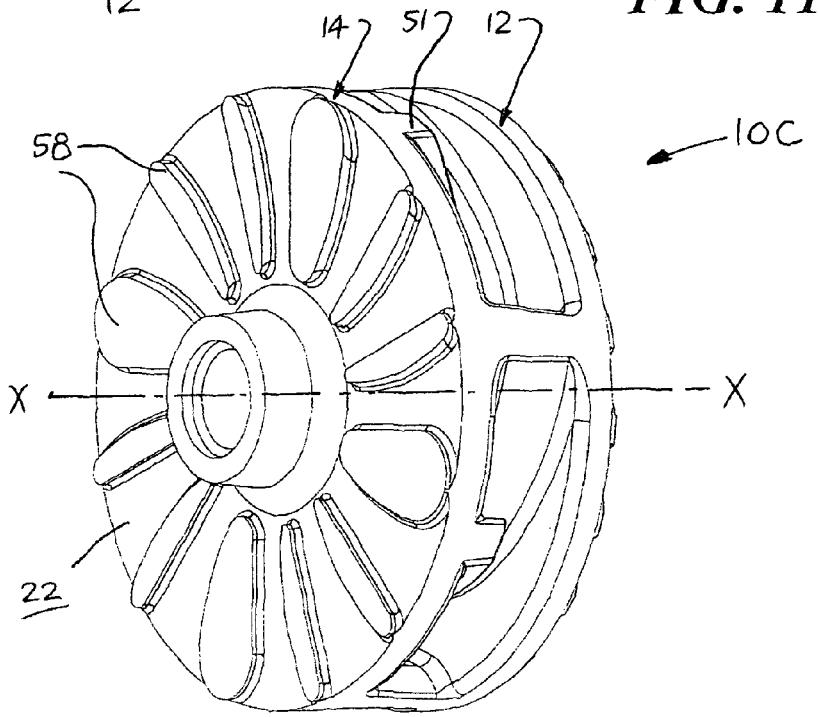
FIG. 12 illustrates a perspective view of the impeller shown in FIGS. 9 to 11 from the rear side.
Figure 13:
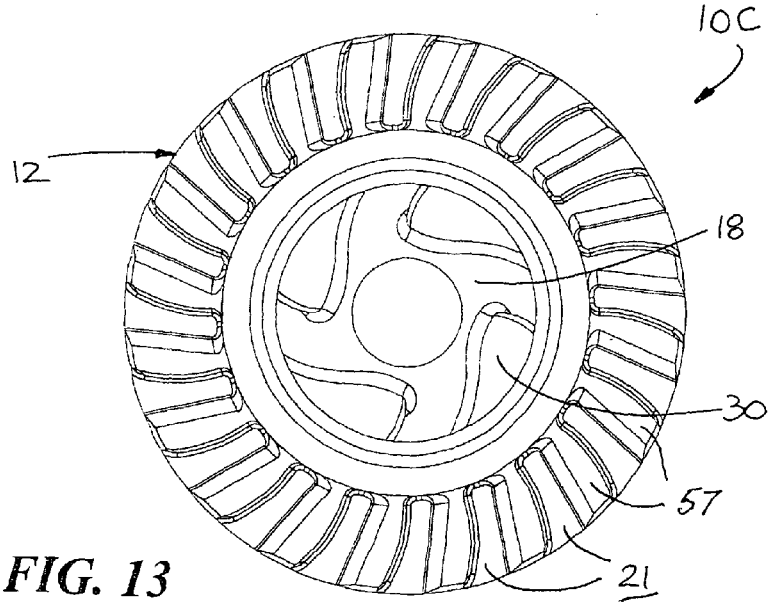
FIG. 13 illustrates a front side elevation of the impeller shown in FIGS. 9 to 12.
Figure 14:
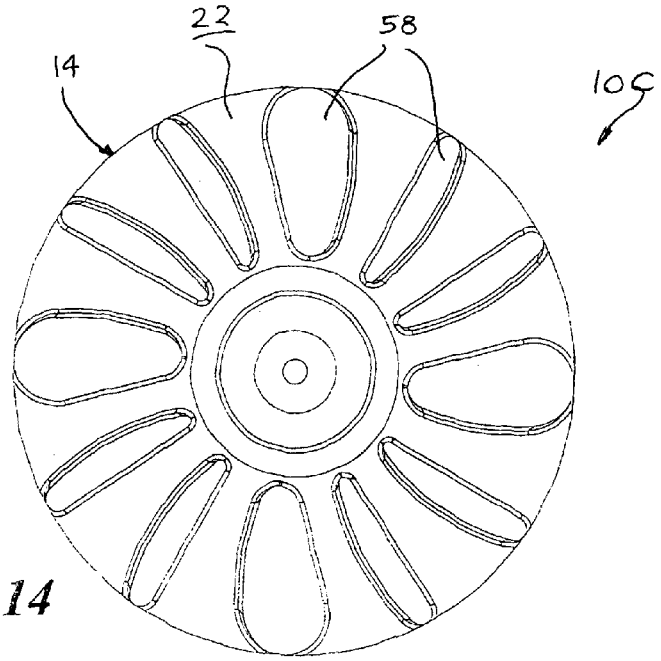
FIG. 14 illustrates a rear side elevation of the impeller shown in FIGS. 9 to 13.
Figure 15:
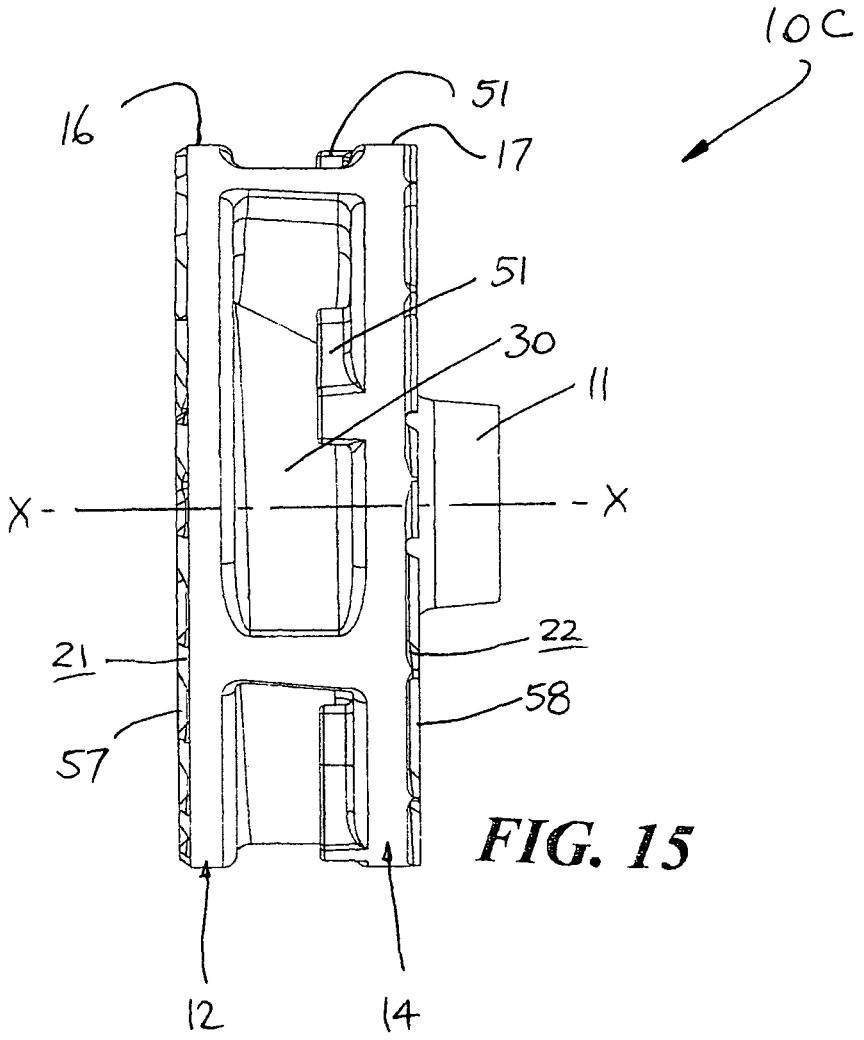
FIG. 15 illustrates a side elevation of the impeller shown in FIGS. 9 to 14.

Referring to FIGS. 9 to 16, a further exemplary impeller 10C is shown in accordance with certain embodiments in which the impeller comprises a front shroud 12 and a back shroud 14 which are each in the form of a generally planar disc, each disc having a respective main inner face 13, 15, a respective outer face 21, 22 and a respective outer peripheral edge 16, 17. A hub 11 extends from an outer face of the back shroud 14, the hub 11 being operatively connectable to a drive shaft (not shown) for causing rotation of the impeller about its central axis X-X. FIGS. 9 and 10 illustrate the position of the impeller with pump inlet component 60.

Figure 16:
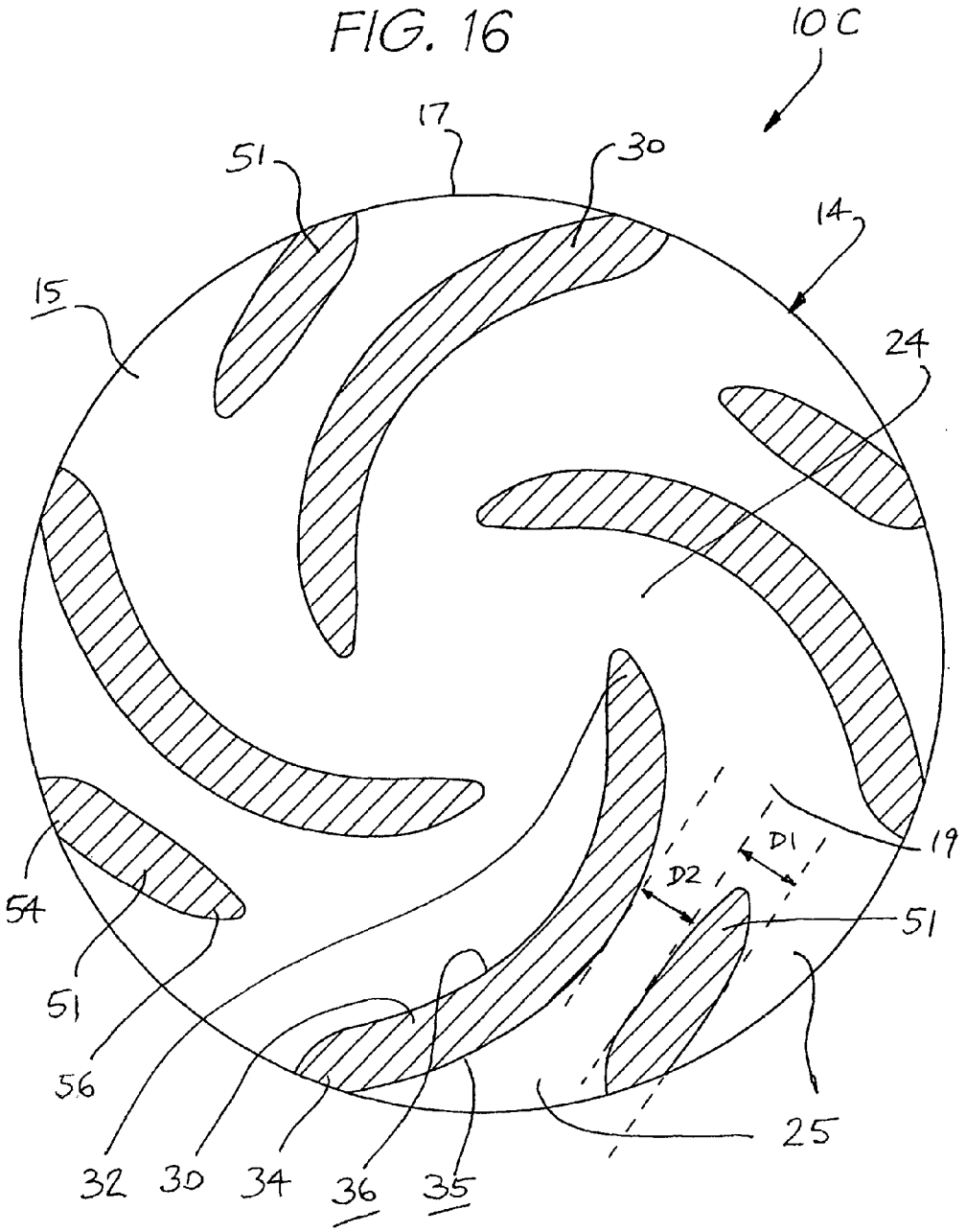
FIG. 16 illustrates a sectional view of the impeller shown in FIGS. 9 to 15 when sectioned across the impeller body to cut across the pumping vanes and the discharge guide vanes.

An impeller inlet 18 is provided in the front shroud 12, the inlet being coaxial with central axis X-X which is the axis of rotation of the impeller in use. Four pumping vanes 30 extend between the opposing main inner faces 13, 15 of the shrouds 12, 14, and are spaced evenly around the main faces of the said shrouds 12, 14. As shown in FIG. 16 each pumping vane 30 is generally arcuate in cross-section and includes an inner leading edge 32 and an outer trailing edge 34 and opposed side faces 35 and 36. Discharge passageways 19 are provided between adjacent pumping vanes 30 through which material passes from impeller inlet 18. As with the previously described embodiments, each passageway 19 has an inlet region 24 and a discharge region 25 located at the outer peripheral edge 16, 17 of the shrouds 12, 14 from which slurry passes to the pump discharge. The discharge region 25 may be wider than the inlet region 24 so that the passageway 19 is generally V-shaped. Reference numerals identifying the various features described above have only been indicated on one of the vanes 30 for the sake of clarity.

In this particular exemplary illustration, the impeller 10C does not have inlet guide vanes but has a plurality of discharge guide vanes 51. The discharge guide vanes 51 are in the form of elongate, flat-topped projections which are generally sausage-shaped in cross-section and tapered at both ends. The discharge vanes 51 extend respectively from the main face 15 of the back shroud 14 and are arranged in between two adjacent pumping vanes 30. The discharge guide vanes 51 have a respective outer end 54, which is located adjacent to the outer peripheral edge of the shroud 14. The discharge guide vanes 51 also have an inner end 56, which is located somewhere midway a respective passageway 19. The inner ends 56, of the discharge guide vanes 51 are spaced some distance from the central axis X-X of the impeller 10C.

Each discharge guide vane 51 shown has a height of about 33% of the width of the impeller pumping vane 30, although in further embodiments the guide vane height can be between 5% to 50% of the said pumping vane width (distance between the shrouds). Each guide vane 51 is of generally constant height along its length, although in other embodiments the guide vane can be tapered in height and also tapered in width. As is apparent from the drawings, the discharge guide vanes 51 can have bevelled peripheral edges.

As shown in FIGS. 9 to 16 the discharge guide vanes are disposed within each respective passageway so as to be spaced from a respective pumping vane surface 35 to which it is closest by about one discharge guide vane thickness D1 into the passageway 19. The discharge guide vane thickness D1 and the spaced apart distance D2 from the pumping vane surface 35 are shown in FIGS. 9, 10 and 16, in which D1 and D2 are about equivalent in dimension. In this instance the impeller vanes extend to a height of about 33% of the impeller pumping vane width. This impeller 10C' corresponds with the embodiment described in FIG. 4 of this specification.

The impeller 10C further includes expeller or auxiliary vanes 57, 58 on respective outer faces 21, 22 of the shrouds 12, 14. Some of the vanes 58 on the back shroud have different widths. As is apparent from the drawings, the expeller vanes have bevelled edges.

Figure 17:
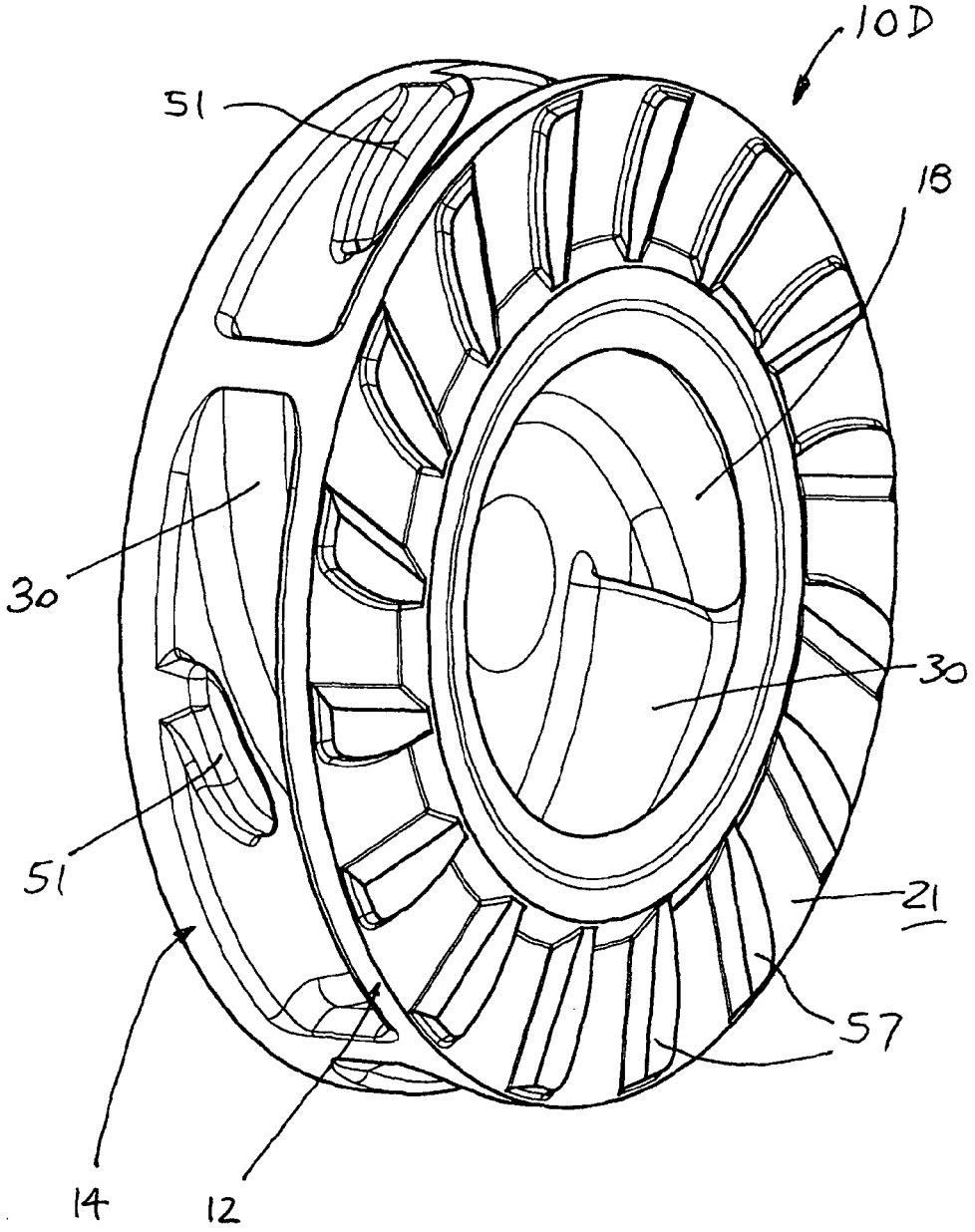
FIG. 17 illustrates an exemplary schematic isometric view of an impeller according to another embodiment.
Figure 18:
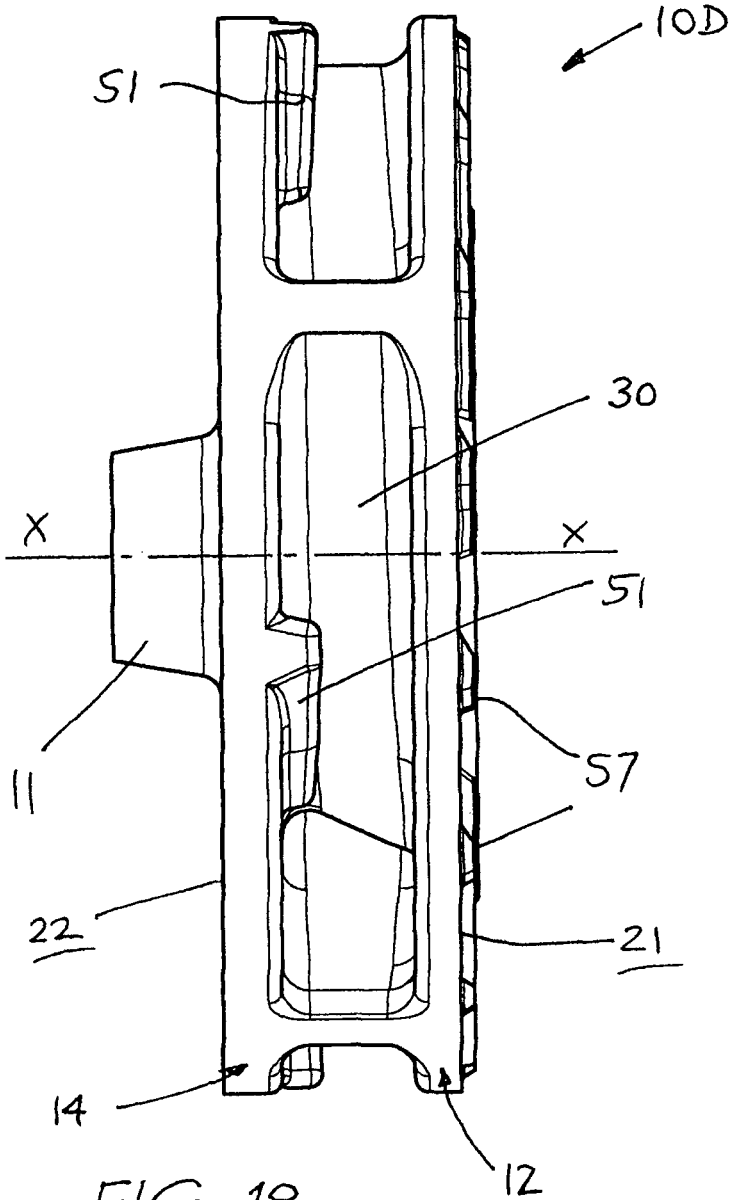
FIG. 18 illustrates a side elevation of the impeller shown in FIG. 17.

Referring to FIGS. 17 and 18, a further exemplary impeller 10D is shown in accordance with certain embodiments in which the impeller comprises a front shroud 12 and a back shroud 14 which are each in the form of a generally planar disc, each disc having a respective main inner face 13, 15, a respective outer face 21, 22 and a respective outer peripheral edge 16, 17. These features are illustrated in FIG. 17. A hub 11 extends from an outer face of the back shroud 140, the hub 11 being operatively connectable to a drive shaft (not shown) for causing rotation of the impeller about its central axis X-X. In all respects the impeller 10D is the same as the impeller 10C shown in FIGS. 9 to 16 with the exception that the front shroud expeller vanes 57 are of a different design shape and edge bevelling, and there are no backshroud impeller vanes present.

EXPERIMENTAL SIMULATION

Computational experiments were carried out to simulate flow in the various designs of impeller disclosed herein, using commercial software ANSYS CFX. This software applies Computational Fluid Dynamics (CFD) methods to solve the velocity field for the fluid being pumped. The software is capable of solving many other variables of interest, however velocity is the variable which is relevant for the figures shown herein.

For each CFD experiment, the results are post-processed using the corresponding module of CFX. The figures show cross-sectional views of four planes A, B, C and D which cut the relevant impeller design perpendicular to its rotational axis at the same depth for each experiment. The velocity vectors are plotted on these four planes to analyse how the fluid and the slurry particles move through the channel formed between the impeller pumping vanes. The size of these vectors together with their distribution density indicates the magnitude of the velocity parameter, and curved vector patterns generally indicate the presence of vortices.

The velocity vectors are plotted on these planes to analyse how the fluid particles move through the channel formed between the impeller pumping vanes.

Experiment 1

Figure 19A:
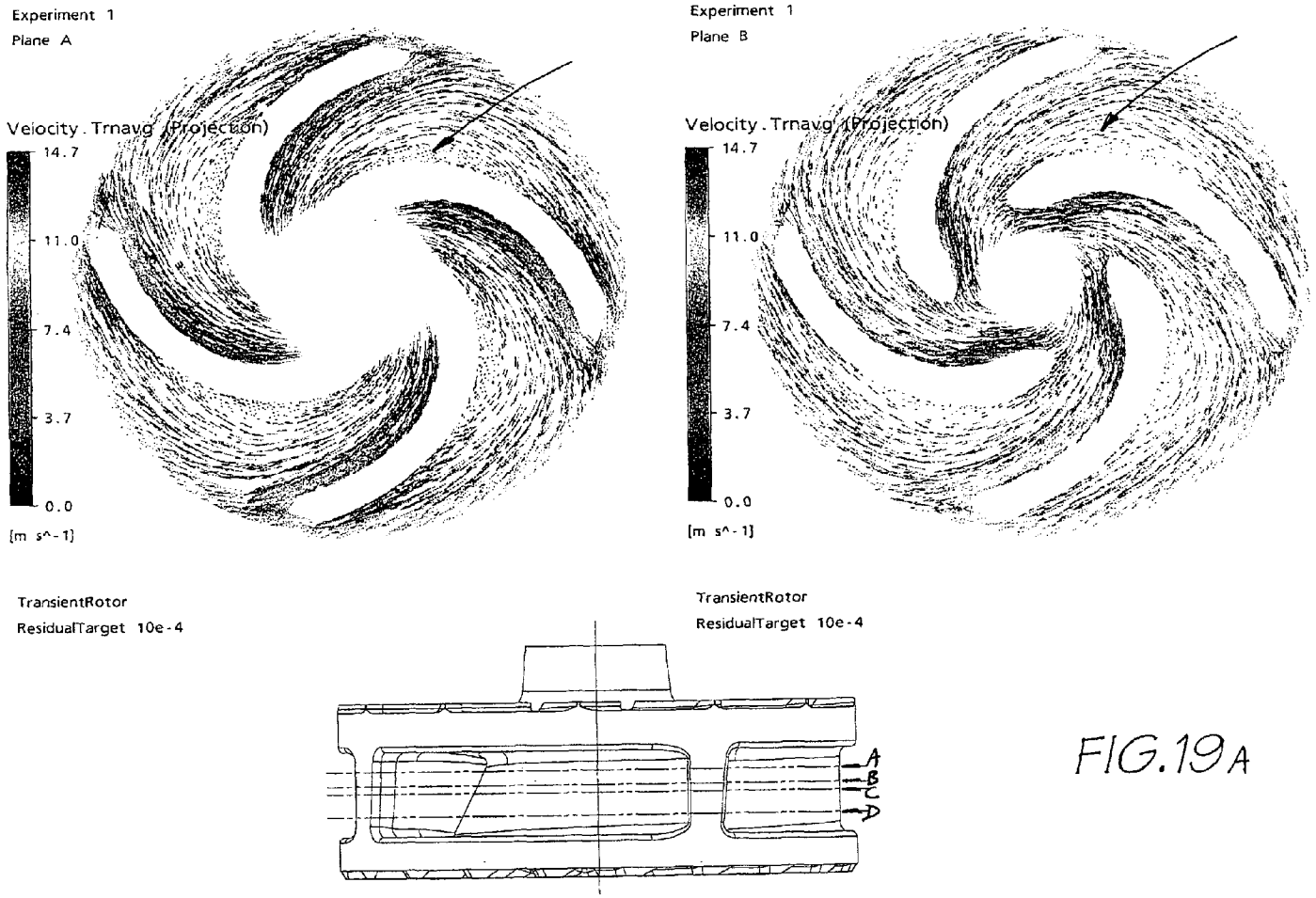
FIGS. 19*a* and 19*b* illustrate some experimental computational simulation results for fluid flow in the embodiment of the impeller which is shown in the drawing.
Figure 19B:
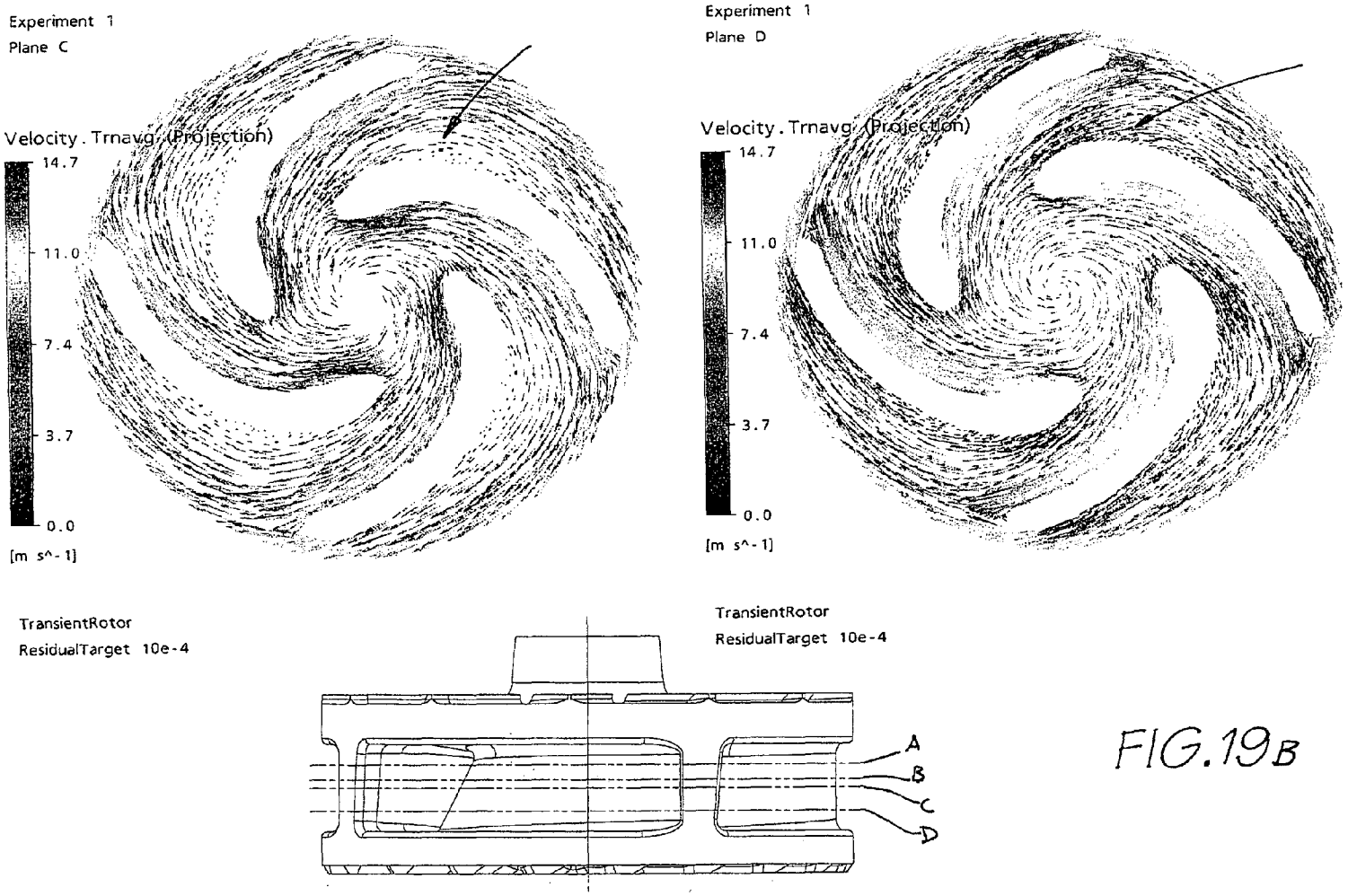

As shown in FIGS. 19(*a*) and 19(*b*) a standard ("baseline") impeller is shown which has a front shroud and a back shroud and four impeller pumping vanes extending between the inner main faces of the shrouds. This impeller does not have any discharge guide vane disposed within a respective passageway, or projecting from the main face of one of the shrouds.

The side view of the impeller shown in FIGS. 19(*a*) and 19(*b*) shows the position of the four planes A, B, C and D which cut the relevant impeller design perpendicular to its rotational axis.

Plane A is positioned at a height above the back shroud which is less than about 35% of the pumping vane width (where the width of the pumping vane is defined as the distance between the front and back shrouds of the impeller).

Plane B is positioned at a height above the back shroud which is less than about 50% of the pumping vane width.

Plane C is positioned at a height above the back shroud which is located at more than 50% but less than 65% of the pumping vane width (and midway the front and back shrouds).

Plane D is positioned at a height above the back shroud which is more than about 65% of the pumping vane width.

The results of Experiment 1 can be seen by reference to the plotted velocity vectors in FIGS. 19(*a*) and 19(*b*), which are labelled Plane A, Plane B, Plane C and Plane D. The size of these vectors together with their distribution density indicates the magnitude of velocity parameter and the presence of vortices. The important area to look at is the region located in front of the pressure surface (or pumping face) of each of the pumping vanes, and extending into the flow discharge passageway between the pumping vanes. The relevant area is indicated in each velocity vector plot by the small arrow.

As can be seen in FIGS. 19(*a*) and 19(*b*), if we think of the core of the vortex as being a conical body, its diameter is noticeably shrinking as we approach the front shroud (moving from Plane A to Plane D). This is the baseline condition of operation.

Experiment 2

Figure 20A:
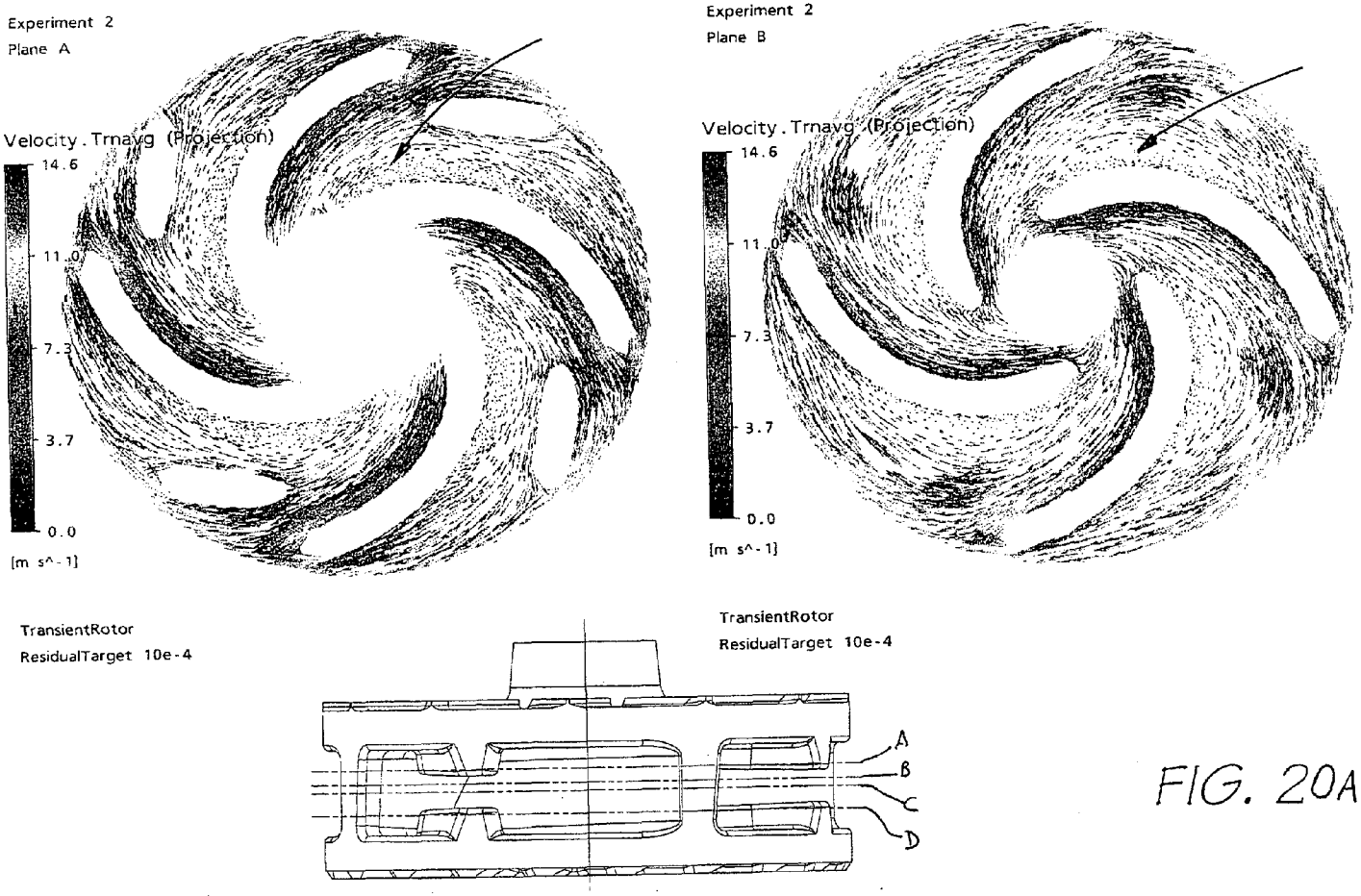
FIGS. 20*a* and 20*b* illustrate some experimental computational simulation results for fluid flow in the embodiment of the impeller which is shown in the drawing.
Figure 20B:
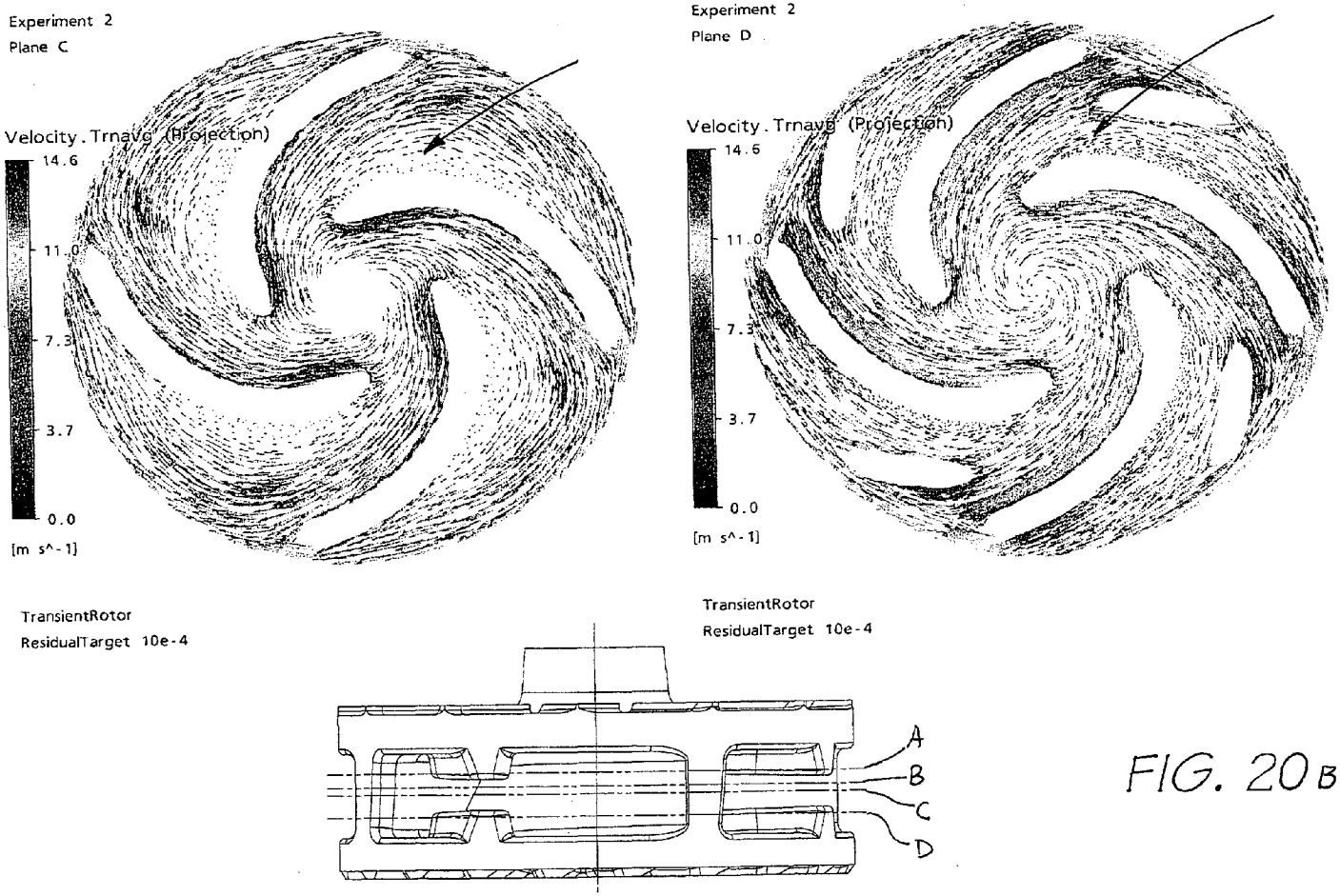

As shown in FIGS. 20(*a*) and 20(*b*) an impeller is shown which has a front shroud and a back shroud and four impeller pumping vanes extending between the inner main faces of the shrouds. The main pumping vanes in Experiments 2 to 5 are all identical to those shown in Experiment 1. This impeller has discharge guide vanes disposed within each respective passageway, projecting from the inner main face of both the front shroud and the back shroud and positioned about midway across the width of the passageway between two pumping vanes. In this instance the impeller vanes extend to a height of about 33% of the impeller pumping vane width. This impeller corresponds with the embodiment shown in FIGS. 5, 6 and 7 of this specification.

The side view of the impeller shown in FIGS. 20(*a*) and 20(*b*) shows the position of the four planes A, B, C and D which cut the relevant impeller design perpendicular to its rotational axis in the same positions as shown in Experiment 1.

The results of Experiment 2 can be seen by reference to the plotted velocity vectors in FIGS. 20(*a*) and 20(*b*), which are labelled Plane A, Plane B, Plane C and Plane D. The size of these vectors together with their distribution density indicates the magnitude of velocity parameter and the presence of vortices. The important area to look at is the region located in front of the pressure surface (or pumping face) of each of the pumping vanes, and extending into the flow discharge passageway between the pumping vanes. The relevant area is indicated in each velocity vector plot by the small arrow.

As can be seen in FIGS. 20(*a*) and 20(*b*), if we think of the core of the vortex as being a conical body, the discharge guide vanes in the positions shown were expected to act to some degree on the core of the vortex to confine its detachment from the pumping face of the pumping vane, however the plotted velocity vector data shows that the action of these dual discharge guide vanes is minimal. This can be seen by comparison of the results of FIGS. 19(*a*) and 19(*b*) with FIGS. 20(*a*) and 20(*b*) respectively.

Experiment 3

Figure 21A:
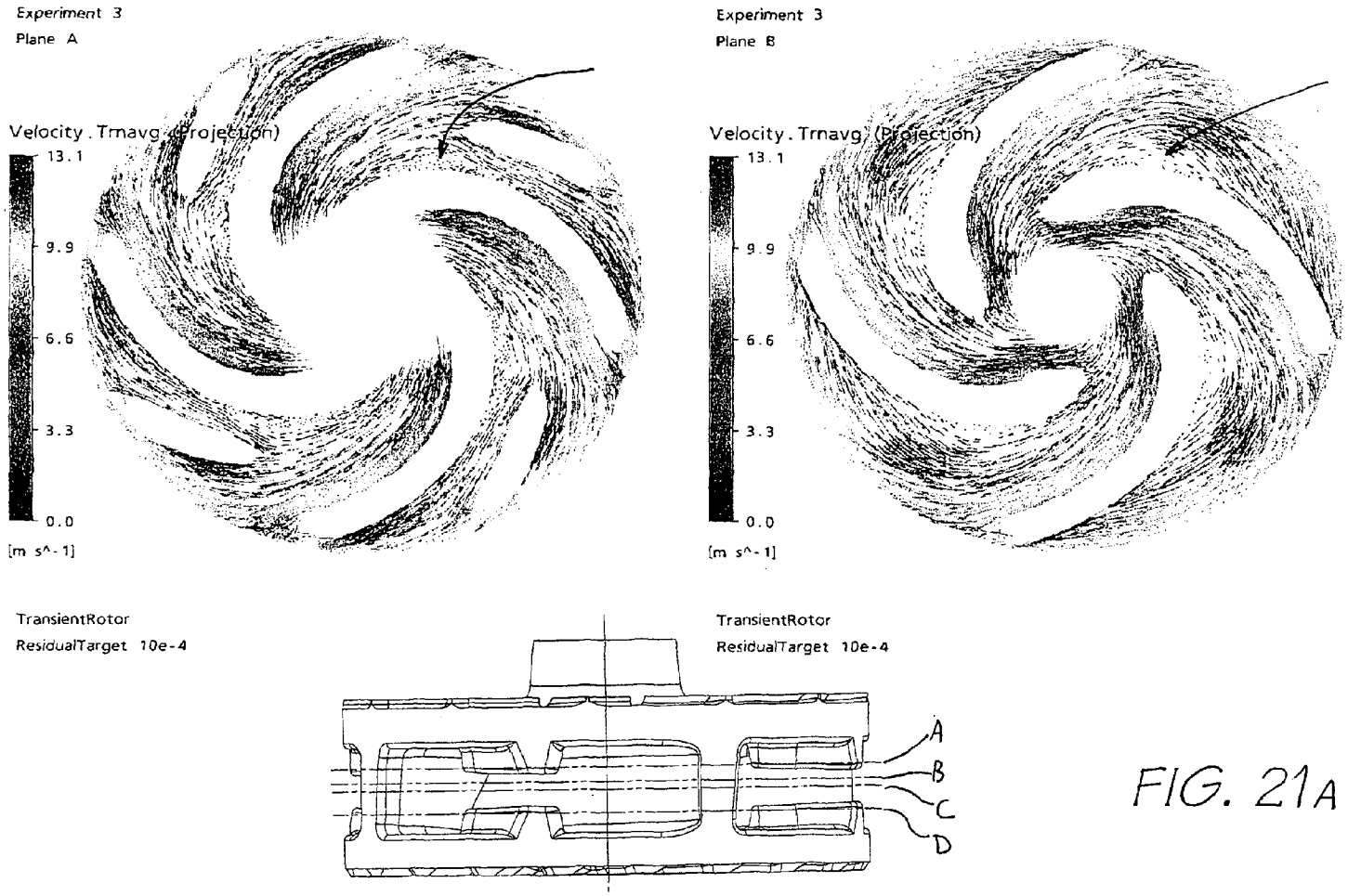
FIGS. 21*a* and 21*b* illustrate some experimental computational simulation results for fluid flow in the embodiment of the impeller which is shown in the drawing.
Figure 21B:
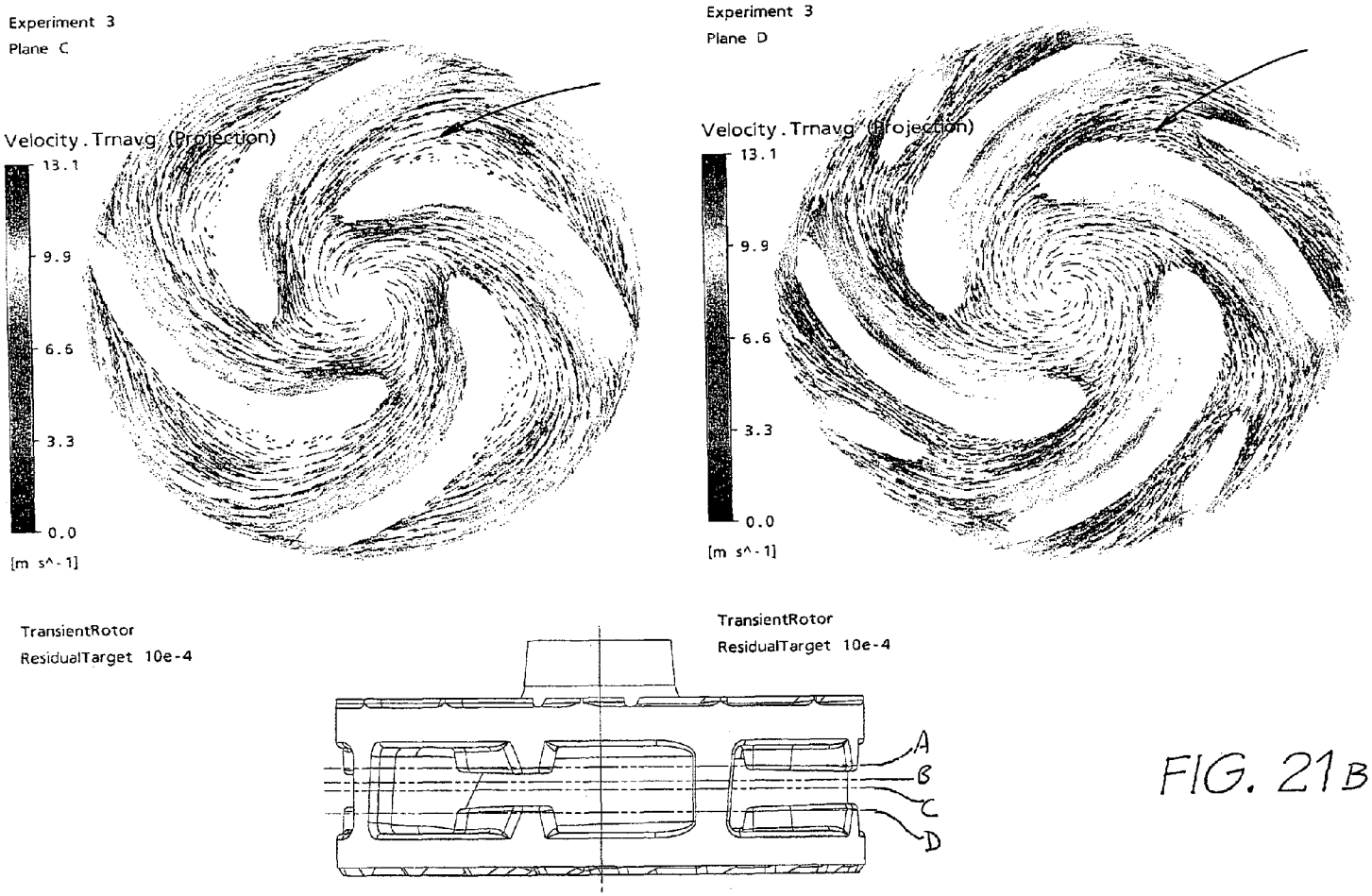

As shown in FIGS. 21(*a*) and 21(*b*) an impeller is shown which has a front shroud and a back shroud and four impeller pumping vanes extending between the inner main faces of the shrouds. This impeller has discharge guide vanes disposed within each respective passageway, projecting from the inner main face of both the front shroud and the back shroud and spaced from a respective pumping vane to which it is closest by about one discharge guide vane thickness into the passageway. In this instance the impeller vanes extend to a height of about 33% of the impeller pumping vane width.

The side view of the impeller shown in FIGS. 21(*a*) and 21(*b*) shows the position of the four planes A, B, C and D which cut the relevant impeller design perpendicular to its rotational axis in the same positions as shown in Experiment 1.

The results of Experiment 3 can be seen by reference to the plotted velocity vectors in FIGS. 21(*a*) and 21(*b*), which are labelled Plane A, Plane B, Plane C and Plane D. The size of these vectors together with their distribution density indicates the magnitude of velocity parameter and the presence of vortices. The important area to look at is the region located in front of the pressure surface (or pumping face) of each of the pumping vanes, and extending into the flow discharge passageway between the pumping vanes. The relevant area is indicated in each velocity vector plot by the small arrow.

As can be seen in FIGS. 21(*a*) and 21(*b*), the discharge guide vane (or vanelet) which is positioned closest to the pumping vane shows an improved effect on the core of the vortex. That is, in the region of the back shroud the vortices are confined by the presence of the discharge guide vane. However, as can be seen by comparison with FIG. 20(*b*), Plane D, there is very little difference between the condition of the vortices in front of the pumping vanes in this Experiment 3 when compared with Experiment 2. This means that the discharge guide vane which is located on the front shroud and which is in closer proximity to the pumping vane only has a small effect on confinement of the vortices. The inventors believe that this result is likely due to the smaller core diameter of the vortex at this front shroud location.

Experiment 4

Figure 22A:
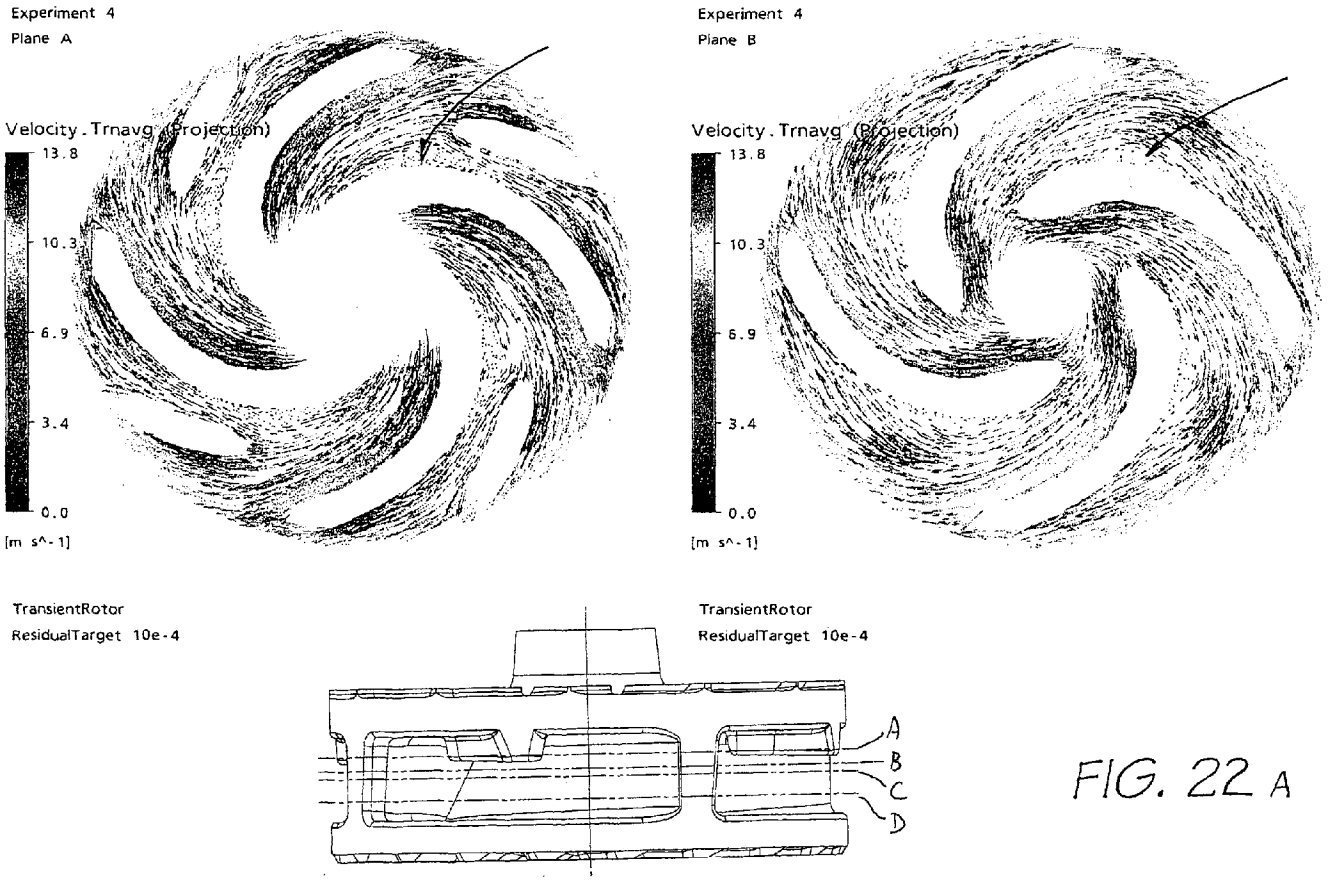
FIGS. 22*a* and 22*b* illustrate some experimental computational simulation results for fluid flow in the embodiment of the impeller which is shown in the drawing.
Figure 22B:
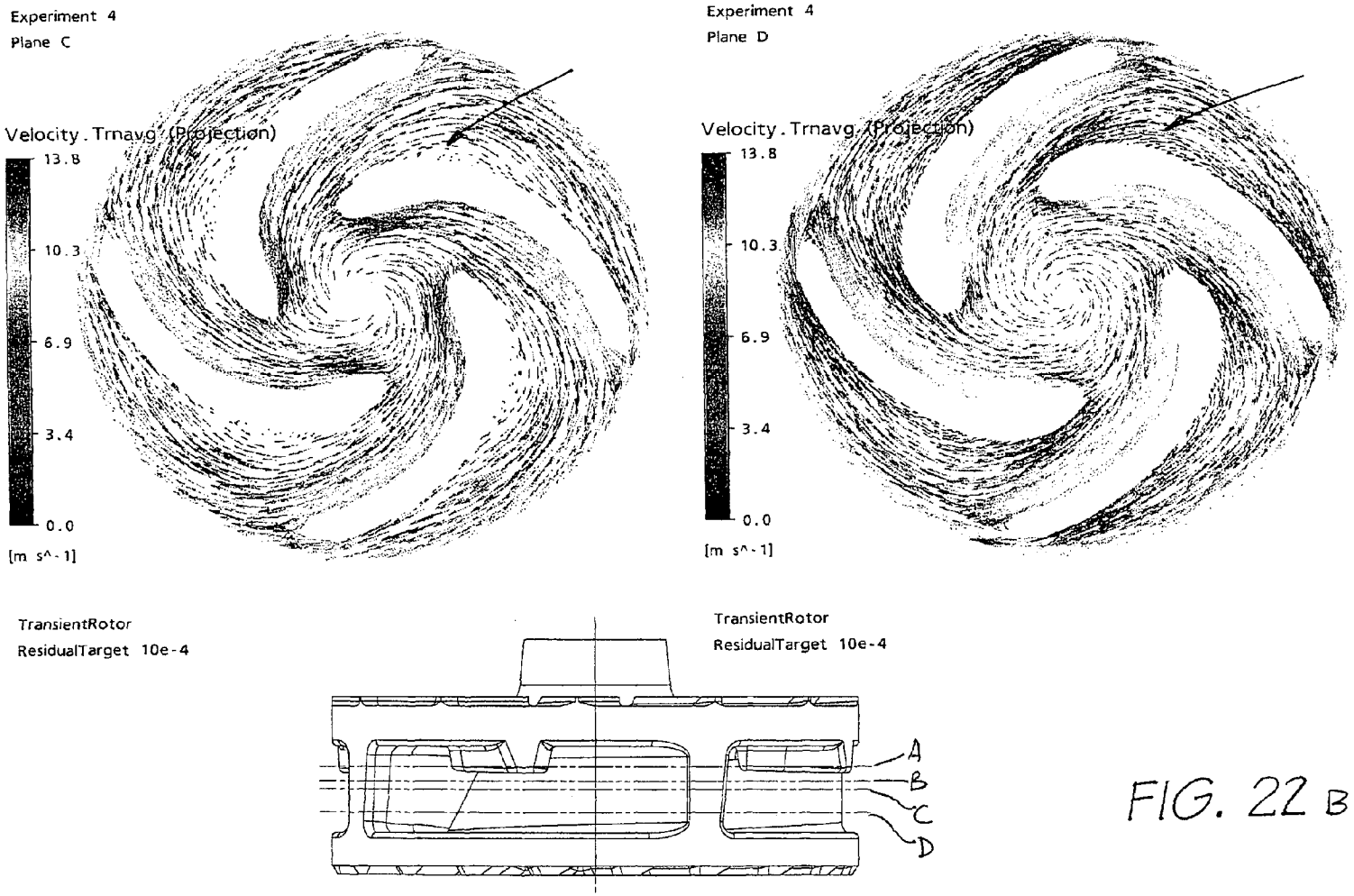
Figure 23A:
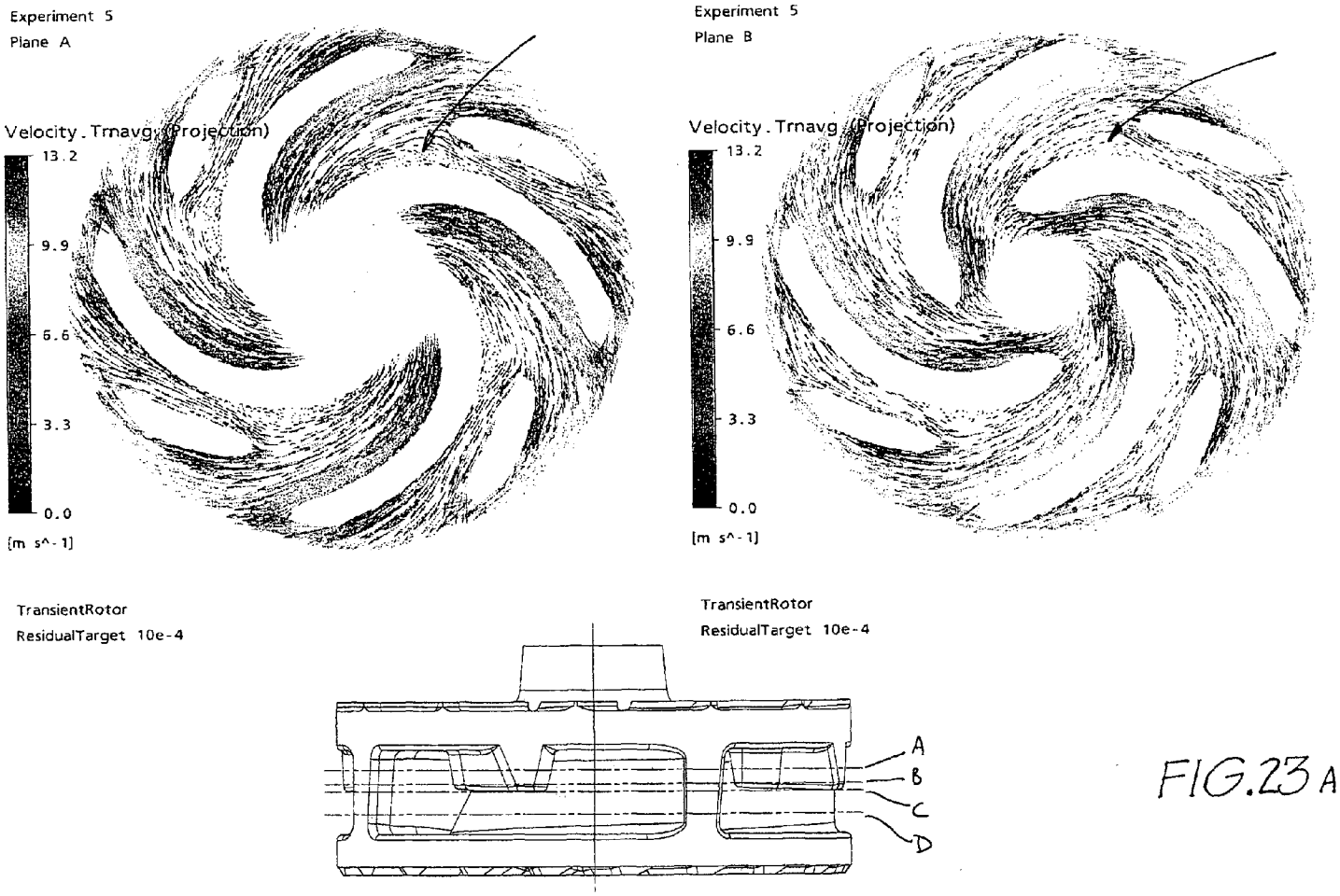
FIGS. 23*a* and 23*b* illustrate some experimental computational simulation results for fluid flow in the embodiment of the impeller which is shown in the drawing.
Figure 23B:
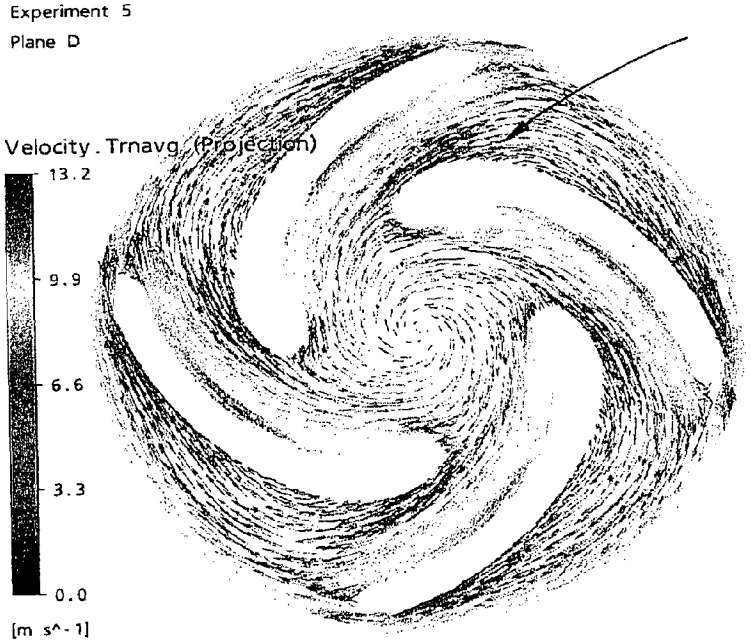
Figure 23B:
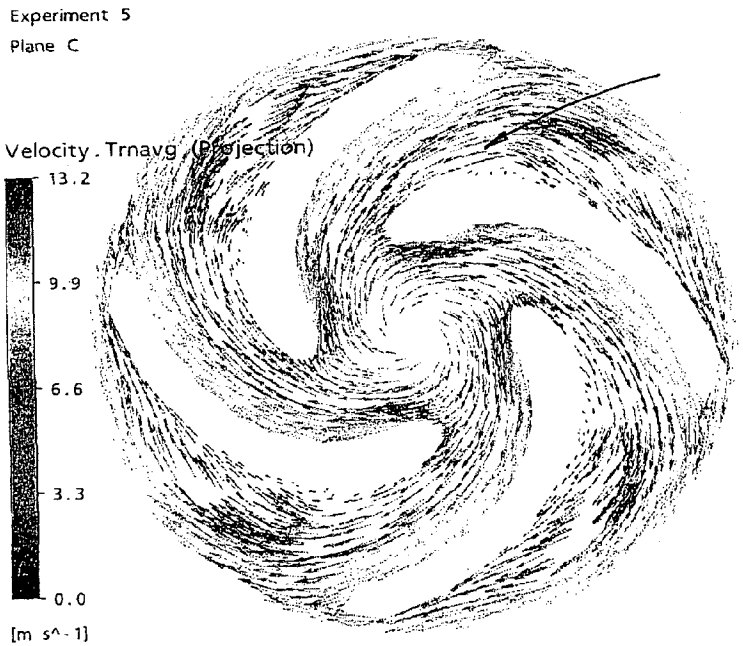
Figure 23B:
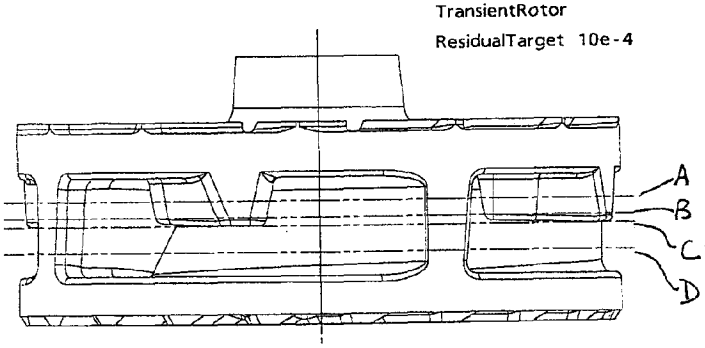

As shown in FIGS. 22(*a*) and 22(*b*) an impeller is shown which has a front shroud and a back shroud and four impeller pumping vanes extending between the inner main faces of the shrouds. This impeller has discharge guide vanes disposed within each respective passageway, projecting from the inner main face of the back shroud only and spaced from a respective pumping vane to which it is closest by about one discharge guide vane thickness into the passageway. In this instance the impeller vanes extend to a height of about 33% of the impeller pumping vane width. This impeller corresponds with the embodiment shown in FIGS. 9 to 16 of this specification.

The side view of the impeller shown in FIGS. 22(*a*) and 22(*b*) shows the position of the four planes A, B, C and D which cut the relevant impeller design perpendicular to its rotational axis in the same positions as shown in Experiment 1.

The results of Experiment 4 can be seen by reference to the plotted velocity vectors in FIGS. 22(*a*) and 22(*b*), which are labelled Plane A, Plane B, Plane C and Plane D. The size of these vectors together with their distribution density indicates the magnitude of velocity parameter and the presence of vortices. The important area to look at is the region located in front of the pressure surface (or pumping face) of each of the pumping vanes, and extending into the flow discharge passageway between the pumping vanes. The relevant area is indicated in each velocity vector plot by the small arrow.

As can be seen in FIGS. 22(*a*) and 22(*b*), there is very little difference between the condition of the vortices in front of the pumping vanes in Experiment 4 when compared with Experiment 3. This means that the discharge guide vanes on the front shroud in Experiment 3 had little or no effect on confinement of the vortices. Experiment 4 would therefore appear to be the optimum design arrangement which minimises the complexity of the impeller design whilst still maximising the confinement effect on the vortices.

Experiment 5

As shown in FIGS. 23(*a*) and 23(*b*) an impeller is shown which has a front shroud and a back shroud and four impeller pumping vanes extending between the inner main faces of the shrouds. This impeller has discharge guide vanes disposed within each respective passageway, projecting from the inner main face of the back shroud only and spaced from a respective pumping vane to which it is closest by about one discharge guide vane thickness into the passageway. In this instance the impeller vanes extend to a height of about 50% of the impeller pumping vane width.

The side view of the impeller shown in FIGS. 23(*a*) and 23(*b*) shows the position of the four planes A, B, C and D which cut the relevant impeller design perpendicular to its rotational axis in the same positions as shown in Experiment 1.

The results of Experiment 5 can be seen by reference to the plotted velocity vectors in FIGS. 23(*a*) and 23(*b*), which are labelled Plane A, Plane B, Plane C and Plane D. The size of these vectors together with their distribution density indicates the magnitude of velocity parameter and the presence of vortices. The important area to look at is the region located in front of the pressure surface (or pumping face) of each of the pumping vanes, and extending into the flow discharge passageway between the pumping vanes. The relevant area is indicated in each velocity vector plot by the small arrow.

As can be seen in FIGS. 23(*a*) and 23(*b*), the extended back shroud guide vanes act on the vortex as shown in Planes A and B, and were expected to confine its detachment from the pumping face of the pumping vane. However, the plotted velocity vector data shows that the action of the increased height guide vanes is minimal on the vortex core when compared with the results shown at an equivalent position in Experiment 4. This can be seen by comparison with FIGS. 22(*a*) and 22(*b*). However the inventors discovered that the presence of a larger guide vane actually reduced the efficiency of the impeller/pump combination, meaning that this design is sub-optimal.

The inventors believe that both the inlet and discharge guide vanes will improve the performance by reducing turbulence within the main flow and also assist to reduce the amount of recirculation, especially when the discharge guide vane is closer to the pressure or pumping side face of the closest adjacent pumping vane. These effects will reduce the energy losses inside the pump impeller and hence improve the overall pump performance in terms of pressure head and efficiency of a slurry pump over a wider flow range from low to high flows. Improved performance over a wider range of flows will also provide less overall wear inside the pump thereby improving the useful operating life of the slurry pump.

The materials used for the impellers disclosed herein may be selected from materials that are suitable for shaping, forming or fitting as described, including hard metals that are high in chromium content or metals that have been treated (for example, tempered) in such a way to include a hardened metal microstructure. The impellers could also be manufactured from other hard-wearing materials such as ceramics, or even made of hard rubber material.

Any of the embodiments of impeller disclosed herein find use in a centrifugal slurry pump of the volute type. Such pumps normally comprising a pump casing having an inlet region and a discharge region, and the impeller is positioned within the pump casing and is rotated therein by a motorised drive shaft which is axially connected to the impeller. Since the impeller is normally a wearing part, then periodically the pump casing is opened and the worn impeller is removed and discarded and is replaced by an unworn impeller which can be of the type disclosed herein. The worn impeller can be of a different design to the new, unworn impeller provided that the new, unworn impeller is interchangeable with the space within the pump casing and the axial connection to the drive shaft.

In some embodiments the impeller is a cast product made of solidified molten metal. The casting process involves pouring the molten metal into a mould and allowing the metal to cool and solidify to form the required impeller shape. The complexity of the casting process depends to some extent on the shape and configuration of the impeller mould, in some cases necessitating special techniques for introducing the molten metal and for detaching the cast product from the mould.

In some embodiments of the impeller it is possible to remove and retrofit a worn inlet or discharge guide vane from its position on the respective pumping vane or shroud after a period of use or, for example, if one of the vanes has broken off during use. Depending on the material of manufacture, the impeller can be repaired by welding, gluing or some other form of mechanical fixing of the replacement guide vane.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front", "back" and the like are used as words of convenience to provide reference points and are not to be construed as limiting terms.

Finally, it is to be understood that various alterations, modifications and/or additions may be incorporated into the various constructions and arrangements of parts without departing from the spirit or ambit of the invention.

The invention claimed is:

1. A slurry pump impeller comprising a front shroud and a back shroud each having an inner main face with an outer peripheral edge and a central axis, a plurality of pumping vanes extending between the inner main faces of the shrouds to define a width of the pumping vanes therebetween, the pumping vanes being disposed in spaced apart relation, each pumping vane including opposed main side faces one of which is a pumping or pressure side face, a leading edge in the region of the central axis and a trailing edge in the region of the outer peripheral edges of the shrouds with a passageway between adjacent pumping vanes, each passageway having associated therewith a discharge guide vane, each discharge guide vane being disposed within a respective passageway and located closer to the pumping or pressure side face of the closest adjacent pumping vane and projecting from the inner main face of at least one of the or each shrouds to a height that is less than the width of the pumping vanes, and wherein each discharge guide vane has an outer end adjacent the peripheral edge of one of the shrouds, the discharge guide vane extending inwardly and terminating at an inner end which is intermediate the central axis and the peripheral edge of the shroud with which it is associated, and wherein each discharge guide vane is shorter in length than the adjacent pumping vane such that the discharge guide vane in use does not obstruct the free flow of material through the passageway.

2. A slurry pump impeller according to claim 1, wherein the length of each discharge guide vane is one third or less of the length of the adjacent pumping vane.

3. A slurry pump impeller according to claim 1, wherein each said discharge guide vane projects from the inner main face of the back shroud.

4. A slurry pump impeller claim 1, wherein each said discharge guide vane has a height which is from 5 to 50 percent of the pumping vane width.

5. A slurry pump impeller according to claim 4, wherein each said discharge guide vane has a height which is from 20 to 40 percent of the pumping vane width.

6. A slurry pump impeller according to claim 4, wherein each said discharge guide vane has a height of 30 to 35 percent of the pumping vane width.

7. A slurry pump impeller according to claim 1, wherein each said discharge guide vane is spaced from a respective pumping vane to which it is closest so as to modify flow of material through the passageway and thereby reduce turbulence and inhibit the displacement or separation of vortices formed by the flow from the face of the said pumping vane.

8. A slurry pump impeller according to claim 1, wherein for at least some of its length each discharge guide vane is spaced from a respective pumping vane to which it is closest at a distance which is equal to the maximum thickness of the discharge guide vane.

9. A slurry pump impeller according to claim 1, wherein each discharge guide vane is of a tapering height.

10. A slurry pump impeller according to claim 1, wherein each discharge guide vane is of a tapering width.

11. A slurry pump impeller according to claim 1, further including auxiliary vanes on an outer face of one or more of the shrouds.

12. A slurry pump impeller according to claim 11 wherein said auxiliary vanes have bevelled edge portions.

13. A slurry pump impeller according to claim 1, wherein the impeller has no more than five pumping vanes.

14. A slurry pump impeller according to claim 13, wherein the impeller has four pumping vanes.

15. A slurry pump impeller comprising a front shroud and a back shroud each having an inner main face with an outer peripheral edge and a central axis, a plurality of pumping vanes extending between the inner main faces of the shrouds to define a width of the pumping vanes therebetween, the pumping vanes being disposed in spaced apart relation, each pumping vane including opposed main side faces one of which is a pumping or pressure side face, a leading edge in the region of the central axis and a trailing edge in the region of the outer peripheral edges of the shrouds with a passageway between adjacent pumping vanes, each passageway having associated therewith a discharge guide vane, each discharge guide vane being disposed within a respective passageway and located closer to the pumping or pressure side face of the closest adjacent pumping vane and projecting from the inner main face of at least one of the or each shrouds to a height that is less than the width of the pumping vanes, and wherein one or more of the passageways have associated therewith one or more inlet guide vanes, each inlet guide vane extending along a side face of the pumping vane and terminating at an opposite end which is intermediate the leading and trailing edges of the pumping vane with which it is associated.

16. A slurry pump impeller according to claim 15 wherein the or each inlet guide vane is a projection from the main face of the pumping vane with which it is associated and which extends into a respective passageway.

17. A slurry pump impeller according to claim 15 wherein each inlet guide vane is elongate.

18. A slurry pump impeller comprising a front shroud and a back shroud each having an inner main face with an outer peripheral edge and a central axis, a plurality of pumping vanes extending between the inner main faces of the shrouds, the pumping vanes being disposed in spaced apart relation, each pumping vane including opposed main side faces one of which is a pumping or pressure side face, a leading edge in the region of the central axis and a trailing edge in the region of the outer peripheral edges of the shrouds with a passageway between adjacent pumping vanes, each passageway having associated therewith a discharge guide vane, the discharge guide vane being disposed within a respective passageway and located closer to one or the other of the pumping vanes and projecting from the inner main face of the back shroud, the length of each discharge guide vane being one third or less of the length of the adjacent pumping vane, said discharge guide vane having a height of 30 to 35 percent of the pumping vane width.

19. A centrifugal slurry pump of the volute type comprising a pump casing having an inlet region and a discharge region, an impeller positioned within the pump casing and a drive shaft axially connected to said impeller, wherein the impeller includes a front shroud and a back shroud each having an inner main face with an outer peripheral edge and a central axis, a plurality of pumping vanes extending between the inner main faces of the shrouds to define a width of the pumping vanes therebetween, the pumping vanes being disposed in spaced apart relation, each pumping vane including opposed main side faces one of which is a pumping or pressure side face, a leading edge in the region of the central axis and a trailing edge in the region of the outer peripheral edges of the shrouds with a passageway between adjacent pumping vanes, each passageway having associated therewith a discharge guide vane, each discharge guide vane being disposed within a respective passageway and located closer to the pumping or pressure side face of the closest adjacent pumping vane and projecting from the inner main face of at least one of the shrouds to a height that is less than the width of the pumping vanes, and wherein each discharge guide vane has an outer end adjacent the peripheral edge of one of the shrouds, the discharge guide vane extending inwardly and terminating at an inner end which is intermediate the central axis and the peripheral edge of the shroud with which it is associated, and wherein each discharge guide vane is shorter in length than the adjacent pumping vane such that the discharge guide vane in use does not obstruct the free flow of material through the passageway.

* * * * *